US007443365B2

(12) United States Patent
Terai et al.

(10) Patent No.: US 7,443,365 B2
(45) Date of Patent: Oct. 28, 2008

(54) DISPLAY UNIT AND DISPLAY METHOD

(75) Inventors: Haruko Terai, Ibaraki (JP); Hideaki Kawamura, Moriyama (JP); Junta Asano, Ibaraki (JP); Mitsuhiro Kasahara, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 428 days.

(21) Appl. No.: 10/541,544

(22) PCT Filed: Dec. 26, 2003

(86) PCT No.: PCT/JP03/17008

§ 371 (c)(1),
(2), (4) Date: Mar. 10, 2006

(87) PCT Pub. No.: WO2004/061810

PCT Pub. Date: Jul. 22, 2004

(65) Prior Publication Data

US 2006/0170619 A1 Aug. 3, 2006

(30) Foreign Application Priority Data

Jan. 6, 2003 (JP) ..... 2003-000242
Dec. 25, 2003 (JP) ..... 2003-431636

(51) Int. Cl.
*G09G 5/10* (2006.01)
*G09G 5/02* (2006.01)
*G09G 3/28* (2006.01)

(52) U.S. Cl. ..... 345/63; 345/690

(58) Field of Classification Search ..... 345/60, 345/63, 596–599, 690, 691, 694–696
See application file for complete search history.

(56) References Cited

U.S. PATENT DOCUMENTS 6,069,609 A * 5/2000 Ishida et al. ..... 345/596

(Continued)

FOREIGN PATENT DOCUMENTS

EP 0994457 4/2000

(Continued)

OTHER PUBLICATIONS

English Language Abstract of JP 2000-276100.

(Continued)

*Primary Examiner*—Amare Mengistu
*Assistant Examiner*—Robert R Rainey
(74) *Attorney, Agent, or Firm*—Greenblum & Bernstein, P.L.C.

(57) ABSTRACT

The combination patterns of emissions and non-emissions from the n-th sub-field to the m-th sub-field (where m and n are integers smaller than the total number of sub-fields, and m is greater than n) for a first pixel, a second pixel, a third pixel, and a fourth pixel that are vertically and horizontally adjacent in each of the areas in a display panel are different from one another. Among the first pixel to the fourth pixel vertically and horizontally adjacent in each area of the display panel, the grayscale value displayed by each of the first pixel and the second pixel arranged in one diagonal positions is lower than the average of the grayscale values displayed by the first pixel to the fourth pixel, while the grayscale value displayed by each of the third pixel and the fourth pixel arranged in the other diagonal positions is higher than the average of the grayscale values displayed by the first pixel to the fourth pixel.

12 Claims, 23 Drawing Sheets

U.S. PATENT DOCUMENTS

| | | | | |
|---|---|---|---|---|
| 6,091,398 | A | 7/2000 | Shigeta | |
| 6,297,788 | B1 | 10/2001 | Shigeta et al. | |
| 6,476,824 | B1 | 11/2002 | Suzuki et al. | |
| 2002/0027566 | A1* | 3/2002 | Naka et al. | 345/696 |
| 2002/0054002 | A1* | 5/2002 | Tokunaga et al. | 345/60 |
| 2002/0135595 | A1 | 9/2002 | Morita et al. | |
| 2002/0180754 | A1 | 12/2002 | Suzuki | |

FOREIGN PATENT DOCUMENTS

| | | |
|---|---|---|
| JP | 8-286634 | 11/1996 |
| JP | 9-81072 | 3/1997 |
| JP | 10-98663 | 4/1998 |
| JP | 11-73157 | 3/1999 |
| JP | 2000-56726 | 2/2000 |
| JP | 2000-148068 | 5/2000 |
| JP | 2000-276100 | 10/2000 |
| JP | 2002-023692 | 1/2002 |
| JP | 2002-82649 | 3/2002 |
| JP | 2002-351381 | 12/2002 |
| WO | 00/43979 | 7/2000 |

OTHER PUBLICATIONS

English Language Abstract of JP 10-98663.
Institute of Television Engineers of Japan Technical Report, "False Contour Noise Observed in Display of Pulse Width Modulated Moving Images," vol. 19, No. 2, IDY 95-21, pp. 61-66, together with a partial English language translation of the same.
English Language Abstract of JP 9-81072.
English Language Abstract of JP 2000-56726.
English Language Abstract of JP 2002-82649.
English Language Abstract of JP 11-73157.
English Language Abstract of JP 2002-351381.
English Language Abstract of JP 2000-148068.
English Language Abstract of JP 8-286634.
English Language Abstract of JP 2002-023692.
U.S. Appl. No. 10/542,416 to Kawamura et al., filed Jul. 15, 2005.

* cited by examiner

Fig. 4a

| GRAY SCALE LEVEL | SUB-FIELD | 10 | 9 | 8 | 7 | 6 | 5 | 4 | 3 | 2 | 1 | FIRST DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 958 | 887 | 1 | 1 | 0 | 1 | 1 | 1 | 0 | 1 | 1 | 1 | -71 |
| 959 | 887 | 1 | 1 | 0 | 1 | 1 | 1 | 0 | 1 | 1 | 1 | -72 |
| 960 | 894 | 1 | 1 | 0 | 1 | 1 | 1 | 1 | 1 | 1 | 0 | -66 |
| 961 | 894 | 1 | 1 | 0 | 1 | 1 | 1 | 1 | 1 | 1 | 0 | -67 |
| 962 | 894 | 1 | 1 | 0 | 1 | 1 | 1 | 1 | 1 | 1 | 0 | -68 |
| 963 | 895 | 1 | 1 | 0 | 1 | 1 | 1 | 1 | 1 | 1 | 1 | -68 |
| 964 | 895 | 1 | 1 | 0 | 1 | 1 | 1 | 1 | 1 | 1 | 1 | -69 |
| 965 | 895 | 1 | 1 | 0 | 1 | 1 | 1 | 1 | 1 | 1 | 1 | -70 |
| 966 | 895 | 1 | 1 | 0 | 1 | 1 | 1 | 1 | 1 | 1 | 1 | -71 |
| 967 | 895 | 1 | 1 | 0 | 1 | 1 | 1 | 1 | 1 | 1 | 1 | -72 |
| 968 | 895 | 1 | 1 | 0 | 1 | 1 | 1 | 1 | 1 | 1 | 1 | -73 |
| 969 | 895 | 1 | 1 | 0 | 1 | 1 | 1 | 1 | 1 | 1 | 1 | -74 |
| 970 | 938 | 1 | 1 | 1 | 0 | 1 | 0 | 1 | 0 | 1 | 0 | -32 |
| 971 | 938 | 1 | 1 | 1 | 0 | 1 | 0 | 1 | 0 | 1 | 0 | -33 |
| 972 | 943 | 1 | 1 | 1 | 0 | 1 | 0 | 1 | 1 | 1 | 1 | -29 |
| 973 | 939 | 1 | 1 | 1 | 0 | 1 | 0 | 1 | 0 | 1 | 1 | -34 |
| 974 | 943 | 1 | 1 | 1 | 0 | 1 | 0 | 1 | 1 | 1 | 1 | -31 |
| 975 | 943 | 1 | 1 | 1 | 0 | 1 | 0 | 1 | 1 | 1 | 1 | -32 |

FIRST GRAY SCALE VALUE

FIRST EMISSION PATTERN

Fig. 4b

| GRAY SCALE LEVEL | SUB-FIELD | 10 | 9 | 8 | 7 | 6 | 5 | 4 | 3 | 2 | 1 | SECOND DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 958 | 950 | 1 | 1 | 1 | 0 | 1 | 1 | 0 | 1 | 1 | 0 | -8 |
| 959 | 955 | 1 | 1 | 1 | 0 | 1 | 1 | 1 | 0 | 1 | 1 | -4 |
| 960 | 951 | 1 | 1 | 1 | 0 | 1 | 1 | 0 | 1 | 1 | 1 | -9 |
| 961 | 955 | 1 | 1 | 1 | 0 | 1 | 1 | 1 | 0 | 1 | 1 | -6 |
| 962 | 959 | 1 | 1 | 1 | 0 | 1 | 1 | 1 | 1 | 1 | 1 | -3 |
| 963 | 959 | 1 | 1 | 1 | 0 | 1 | 1 | 1 | 1 | 1 | 1 | -4 |
| 964 | 959 | 1 | 1 | 1 | 0 | 1 | 1 | 1 | 1 | 1 | 1 | -5 |
| 965 | 959 | 1 | 1 | 1 | 0 | 1 | 1 | 1 | 1 | 1 | 1 | -6 |
| 966 | 959 | 1 | 1 | 1 | 0 | 1 | 1 | 1 | 1 | 1 | 1 | -7 |
| 967 | 959 | 1 | 1 | 1 | 0 | 1 | 1 | 1 | 1 | 1 | 1 | -8 |
| 968 | 959 | 1 | 1 | 1 | 0 | 1 | 1 | 1 | 1 | 1 | 1 | -9 |
| 969 | 959 | 1 | 1 | 1 | 0 | 1 | 1 | 1 | 1 | 1 | 1 | -10 |
| 970 | 949 | 1 | 1 | 1 | 0 | 1 | 1 | 0 | 1 | 0 | 1 | -21 |
| 971 | 951 | 1 | 1 | 1 | 0 | 1 | 1 | 0 | 1 | 1 | 1 | -20 |
| 972 | 950 | 1 | 1 | 1 | 0 | 1 | 1 | 0 | 1 | 1 | 0 | -22 |
| 973 | 958 | 1 | 1 | 1 | 0 | 1 | 1 | 1 | 1 | 1 | 0 | -15 |
| 974 | 958 | 1 | 1 | 1 | 0 | 1 | 1 | 1 | 1 | 1 | 0 | -16 |
| 975 | 959 | 1 | 1 | 1 | 0 | 1 | 1 | 1 | 1 | 1 | 1 | -16 |

SECOND GRAY SCALE LEVEL

SECOND EMISSION PATTERN

Fig. 4c

| GRAY SCALE LEVEL | SUB-FIELD | 10 | 9 | 8 | 7 | 6 | 5 | 4 | 3 | 2 | 1 | THIRD DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 958 | 989 | 1 | 1 | 1 | 1 | 0 | 1 | 1 | 1 | 0 | 1 | 31 |
| 959 | 989 | 1 | 1 | 1 | 1 | 0 | 1 | 1 | 1 | 0 | 1 | 30 |
| 960 | 989 | 1 | 1 | 1 | 1 | 0 | 1 | 1 | 1 | 0 | 1 | 29 |
| 961 | 989 | 1 | 1 | 1 | 1 | 0 | 1 | 1 | 1 | 0 | 1 | 28 |
| 962 | 989 | 1 | 1 | 1 | 1 | 0 | 1 | 1 | 1 | 0 | 1 | 27 |
| 963 | 989 | 1 | 1 | 1 | 1 | 0 | 1 | 1 | 1 | 0 | 1 | 26 |
| 964 | 989 | 1 | 1 | 1 | 1 | 0 | 1 | 1 | 1 | 0 | 1 | 25 |
| 965 | 989 | 1 | 1 | 1 | 1 | 0 | 1 | 1 | 1 | 0 | 1 | 24 |
| 966 | 989 | 1 | 1 | 1 | 1 | 0 | 1 | 1 | 1 | 0 | 1 | 23 |
| 967 | 989 | 1 | 1 | 1 | 1 | 0 | 1 | 1 | 1 | 0 | 1 | 22 |
| 968 | 989 | 1 | 1 | 1 | 1 | 0 | 1 | 1 | 1 | 0 | 1 | 21 |
| 969 | 989 | 1 | 1 | 1 | 1 | 0 | 1 | 1 | 1 | 0 | 1 | 20 |
| 970 | 989 | 1 | 1 | 1 | 1 | 0 | 1 | 1 | 1 | 0 | 1 | 19 |
| 971 | 989 | 1 | 1 | 1 | 1 | 0 | 1 | 1 | 1 | 0 | 1 | 18 |
| 972 | 989 | 1 | 1 | 1 | 1 | 0 | 1 | 1 | 1 | 0 | 1 | 17 |
| 973 | 989 | 1 | 1 | 1 | 1 | 0 | 1 | 1 | 1 | 0 | 1 | 16 |
| 974 | 989 | 1 | 1 | 1 | 1 | 0 | 1 | 1 | 1 | 0 | 1 | 15 |
| 975 | 989 | 1 | 1 | 1 | 1 | 0 | 1 | 1 | 1 | 0 | 1 | 14 |

THIRD GRAY SCALE LEVEL

THIRD EMISSION PATTERN

Fig. 4d

| GRAY SCALE LEVEL | SUB-FIELD | 10 | 9 | 8 | 7 | 6 | 5 | 4 | 3 | 2 | 1 | FOURTH DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 958 | 1006 | 1 | 1 | 1 | 1 | 1 | 0 | 1 | 1 | 1 | 0 | 48 |
| 959 | 1006 | 1 | 1 | 1 | 1 | 1 | 0 | 1 | 1 | 1 | 0 | 47 |
| 960 | 1006 | 1 | 1 | 1 | 1 | 1 | 0 | 1 | 1 | 1 | 0 | 46 |
| 961 | 1006 | 1 | 1 | 1 | 1 | 1 | 0 | 1 | 1 | 1 | 0 | 45 |
| 962 | 1006 | 1 | 1 | 1 | 1 | 1 | 0 | 1 | 1 | 1 | 0 | 44 |
| 963 | 1006 | 1 | 1 | 1 | 1 | 1 | 0 | 1 | 1 | 1 | 0 | 43 |
| 964 | 1006 | 1 | 1 | 1 | 1 | 1 | 0 | 1 | 1 | 1 | 0 | 42 |
| 965 | 1006 | 1 | 1 | 1 | 1 | 1 | 0 | 1 | 1 | 1 | 0 | 41 |
| 966 | 1006 | 1 | 1 | 1 | 1 | 1 | 0 | 1 | 1 | 1 | 0 | 40 |
| 967 | 1006 | 1 | 1 | 1 | 1 | 1 | 0 | 1 | 1 | 1 | 0 | 39 |
| 968 | 1006 | 1 | 1 | 1 | 1 | 1 | 0 | 1 | 1 | 1 | 0 | 38 |
| 969 | 1006 | 1 | 1 | 1 | 1 | 1 | 0 | 1 | 1 | 1 | 0 | 37 |
| 970 | 1006 | 1 | 1 | 1 | 1 | 1 | 0 | 1 | 1 | 1 | 0 | 36 |
| 971 | 1006 | 1 | 1 | 1 | 1 | 1 | 0 | 1 | 1 | 1 | 0 | 35 |
| 972 | 1006 | 1 | 1 | 1 | 1 | 1 | 0 | 1 | 1 | 1 | 0 | 34 |
| 973 | 1006 | 1 | 1 | 1 | 1 | 1 | 0 | 1 | 1 | 1 | 0 | 33 |
| 974 | 1006 | 1 | 1 | 1 | 1 | 1 | 0 | 1 | 1 | 1 | 0 | 32 |
| 975 | 1006 | 1 | 1 | 1 | 1 | 1 | 0 | 1 | 1 | 1 | 0 | 31 |

FOURTH GRAY SCALE LEVEL

FOURTH EMISSION PATTERN

Fig. 4e

| GRAY SCALE LEVEL | FIRST GRAY SCALE VALUE | SECOND GRAY SCALE LEVEL | THIRD GRAY SCALE LEVEL | FOURTH GRAY SCALE LEVEL | AVERAGE VALUE | ERROR |
|---|---|---|---|---|---|---|
| 958 | 887 | 950 | 989 | 1006 | 958 | 0.00 |
| 959 | 887 | 955 | 989 | 1006 | 959.25 | -0.25 |
| 960 | 894 | 951 | 989 | 1006 | 960 | 0.00 |
| 961 | 894 | 955 | 989 | 1006 | 961 | 0.00 |
| 962 | 894 | 959 | 989 | 1006 | 962 | 0.00 |
| 963 | 895 | 959 | 989 | 1006 | 962.25 | 0.75 |
| 964 | 895 | 959 | 989 | 1006 | 962.25 | 1.75 |
| 965 | 895 | 959 | 989 | 1006 | 962.25 | 2.75 |
| 966 | 895 | 959 | 989 | 1006 | 962.25 | 3.75 |
| 967 | 895 | 959 | 989 | 1006 | 962.25 | 4.75 |
| 968 | 895 | 959 | 989 | 1006 | 962.25 | 5.75 |
| 969 | 895 | 959 | 989 | 1006 | 962.25 | 6.75 |
| 970 | 938 | 949 | 989 | 1006 | 970.5 | -0.50 |
| 971 | 938 | 951 | 989 | 1006 | 971 | 0.00 |
| 972 | 943 | 950 | 989 | 1006 | 972 | 0.00 |
| 973 | 939 | 958 | 989 | 1006 | 973 | 0.00 |
| 974 | 943 | 958 | 989 | 1006 | 974 | 0.00 |
| 975 | 943 | 959 | 989 | 1006 | 974.25 | 0.75 |

Fig. 8a

| GRAY SCALE LEVEL | SUB-FIELD | 10 | 9 | 8 | 7 | 6 | 5 | 4 | 3 | 2 | 1 | FIRST DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 7 | 0 | 0 | 0 | 0 | 0 | 0 | 0 | 1 | 1 | 1 | -5 |
| 13 | 11 | 0 | 0 | 0 | 0 | 0 | 0 | 1 | 0 | 1 | 1 | -2 |
| 14 | 11 | 0 | 0 | 0 | 0 | 0 | 0 | 1 | 0 | 1 | 1 | -3 |
| 15 | 11 | 0 | 0 | 0 | 0 | 0 | 0 | 1 | 0 | 1 | 1 | -4 |
| 16 | 13 | 0 | 0 | 0 | 0 | 0 | 0 | 1 | 1 | 0 | 1 | -3 |
| 17 | 13 | 0 | 0 | 0 | 0 | 0 | 0 | 1 | 1 | 0 | 1 | -4 |
| 18 | 13 | 0 | 0 | 0 | 0 | 0 | 0 | 1 | 1 | 0 | 1 | -5 |
| 19 | 13 | 0 | 0 | 0 | 0 | 0 | 0 | 1 | 1 | 0 | 1 | -6 |
| 20 | 14 | 0 | 0 | 0 | 0 | 0 | 0 | 1 | 1 | 1 | 0 | -6 |
| 21 | 14 | 0 | 0 | 0 | 0 | 0 | 0 | 1 | 1 | 1 | 0 | -7 |
| 22 | 14 | 0 | 0 | 0 | 0 | 0 | 0 | 1 | 1 | 1 | 0 | -8 |
| **23** | 15 | 0 | 0 | 0 | 0 | 0 | 0 | 1 | 1 | 1 | 1 | -8 |
| **24** | 15 | 0 | 0 | 0 | 0 | 0 | 0 | 1 | 1 | 1 | 1 | -9 |
| 25 | 15 | 0 | 0 | 0 | 0 | 0 | 0 | 1 | 1 | 1 | 1 | -10 |
| 26 | 22 | 0 | 0 | 0 | 0 | 0 | 1 | 0 | 1 | 1 | 0 | -4 |
| 27 | 23 | 0 | 0 | 0 | 0 | 0 | 1 | 0 | 1 | 1 | 1 | -4 |
| 28 | 23 | 0 | 0 | 0 | 0 | 0 | 1 | 0 | 1 | 1 | 1 | -5 |
| 29 | 23 | 0 | 0 | 0 | 0 | 0 | 1 | 0 | 1 | 1 | 1 | -6 |
| 30 | 23 | 0 | 0 | 0 | 0 | 0 | 1 | 0 | 1 | 1 | 1 | -7 |
| 31 | 23 | 0 | 0 | 0 | 0 | 0 | 1 | 0 | 1 | 1 | 1 | -8 |
| 32 | 23 | 0 | 0 | 0 | 0 | 0 | 1 | 0 | 1 | 1 | 1 | -9 |

FIRST GRAY SCALE VALUE

FIRST EMISSION PATTERN

Fig. 8b

| GRAY SCALE LEVEL | SUB-FIELD | 10 | 9 | 8 | 7 | 6 | 5 | 4 | 3 | 2 | 1 | SECOND DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 11 | 0 | 0 | 0 | 0 | 0 | 0 | 1 | 0 | 1 | 1 | -1 |
| 13 | 13 | 0 | 0 | 0 | 0 | 0 | 0 | 1 | 1 | 0 | 1 | 0 |
| 14 | 13 | 0 | 0 | 0 | 0 | 0 | 0 | 1 | 1 | 0 | 1 | -1 |
| 15 | 13 | 0 | 0 | 0 | 0 | 0 | 0 | 1 | 1 | 0 | 1 | -2 |
| 16 | 14 | 0 | 0 | 0 | 0 | 0 | 0 | 1 | 1 | 1 | 0 | -2 |
| 17 | 14 | 0 | 0 | 0 | 0 | 0 | 0 | 1 | 1 | 1 | 0 | -3 |
| 18 | 14 | 0 | 0 | 0 | 0 | 0 | 0 | 1 | 1 | 1 | 0 | -4 |
| 19 | 15 | 0 | 0 | 0 | 0 | 0 | 0 | 1 | 1 | 1 | 1 | -4 |
| 20 | 15 | 0 | 0 | 0 | 0 | 0 | 0 | 1 | 1 | 1 | 1 | -5 |
| 21 | 15 | 0 | 0 | 0 | 0 | 0 | 0 | 1 | 1 | 1 | 1 | -6 |
| 22 | 22 | 0 | 0 | 0 | 0 | 0 | 1 | 0 | 1 | 1 | 0 | 0 |
| **23** | 22 | 0 | 0 | 0 | 0 | 0 | 1 | 0 | 1 | 1 | 0 | -1 |
| **24** | 23 | 0 | 0 | 0 | 0 | 0 | 1 | 0 | 1 | 1 | 1 | -1 |
| 25 | 27 | 0 | 0 | 0 | 0 | 0 | 1 | 1 | 0 | 1 | 1 | 2 |
| 26 | 27 | 0 | 0 | 0 | 0 | 0 | 1 | 1 | 0 | 1 | 1 | 1 |
| 27 | 27 | 0 | 0 | 0 | 0 | 0 | 1 | 1 | 0 | 1 | 1 | 0 |
| 28 | 27 | 0 | 0 | 0 | 0 | 0 | 1 | 1 | 0 | 1 | 1 | -1 |
| 29 | 27 | 0 | 0 | 0 | 0 | 0 | 1 | 1 | 0 | 1 | 1 | -2 |
| 30 | 27 | 0 | 0 | 0 | 0 | 0 | 1 | 1 | 0 | 1 | 1 | -3 |
| 31 | 27 | 0 | 0 | 0 | 0 | 0 | 1 | 1 | 0 | 1 | 1 | -4 |
| 32 | 27 | 0 | 0 | 0 | 0 | 0 | 1 | 1 | 0 | 1 | 1 | -5 |

SECOND GRAY SCALE LEVEL

SECOND EMISSION PATTERN

Fig. 8c

| GRAY SCALE LEVEL | SUB-FIELD | 10 | 9 | 8 | 7 | 6 | 5 | 4 | 3 | 2 | 1 | THIRD DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 14 | 0 | 0 | 0 | 0 | 0 | 0 | 1 | 1 | 1 | 0 | 2 |
| 13 | 14 | 0 | 0 | 0 | 0 | 0 | 0 | 1 | 1 | 1 | 0 | 1 |
| 14 | 14 | 0 | 0 | 0 | 0 | 0 | 0 | 1 | 1 | 1 | 0 | 0 |
| 15 | 14 | 0 | 0 | 0 | 0 | 0 | 0 | 1 | 1 | 1 | 0 | -1 |
| 16 | 15 | 0 | 0 | 0 | 0 | 0 | 0 | 1 | 1 | 1 | 1 | -1 |
| 17 | 15 | 0 | 0 | 0 | 0 | 0 | 0 | 1 | 1 | 1 | 1 | -2 |
| 18 | 22 | 0 | 0 | 0 | 0 | 0 | 1 | 0 | 1 | 1 | 0 | 4 |
| 19 | 22 | 0 | 0 | 0 | 0 | 0 | 1 | 0 | 1 | 1 | 0 | 3 |
| 20 | 23 | 0 | 0 | 0 | 0 | 0 | 1 | 0 | 1 | 1 | 1 | 3 |
| 21 | 26 | 0 | 0 | 0 | 0 | 0 | 1 | 1 | 0 | 1 | 0 | 5 |
| 22 | 26 | 0 | 0 | 0 | 0 | 0 | 1 | 1 | 0 | 1 | 0 | 4 |
| **23** | 26 | 0 | 0 | 0 | 0 | 0 | 1 | 1 | 0 | 1 | 0 | 3 |
| **24** | 28 | 0 | 0 | 0 | 0 | 0 | 1 | 1 | 1 | 0 | 0 | 4 |
| 25 | 28 | 0 | 0 | 0 | 0 | 0 | 1 | 1 | 1 | 0 | 0 | 3 |
| 26 | 28 | 0 | 0 | 0 | 0 | 0 | 1 | 1 | 1 | 0 | 0 | 2 |
| 27 | 28 | 0 | 0 | 0 | 0 | 0 | 1 | 1 | 1 | 0 | 0 | 1 |
| 28 | 29 | 0 | 0 | 0 | 0 | 0 | 1 | 1 | 1 | 0 | 1 | 1 |
| 29 | 29 | 0 | 0 | 0 | 0 | 0 | 1 | 1 | 1 | 0 | 1 | 0 |
| 30 | 29 | 0 | 0 | 0 | 0 | 0 | 1 | 1 | 1 | 0 | 1 | -1 |
| 31 | 29 | 0 | 0 | 0 | 0 | 0 | 1 | 1 | 1 | 0 | 1 | -2 |
| 32 | 31 | 0 | 0 | 0 | 0 | 0 | 1 | 1 | 1 | 1 | 1 | -1 |

THIRD GRAY SCALE LEVEL

THIRD EMISSION PATTERN

Fig. 8d

| GRAY SCALE LEVEL | SUB-FIELD | 10 | 9 | 8 | 7 | 6 | 5 | 4 | 3 | 2 | 1 | FOURTH DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 15 | 0 | 0 | 0 | 0 | 0 | 0 | 1 | 1 | 1 | 1 | 3 |
| 13 | 15 | 0 | 0 | 0 | 0 | 0 | 0 | 1 | 1 | 1 | 1 | 2 |
| 14 | 15 | 0 | 0 | 0 | 0 | 0 | 0 | 1 | 1 | 1 | 1 | 1 |
| 15 | 23 | 0 | 0 | 0 | 0 | 0 | 1 | 0 | 1 | 1 | 1 | 8 |
| 16 | 23 | 0 | 0 | 0 | 0 | 0 | 1 | 0 | 1 | 1 | 1 | 7 |
| 17 | 23 | 0 | 0 | 0 | 0 | 0 | 1 | 0 | 1 | 1 | 1 | 6 |
| 18 | 26 | 0 | 0 | 0 | 0 | 0 | 1 | 1 | 0 | 1 | 0 | 8 |
| 19 | 26 | 0 | 0 | 0 | 0 | 0 | 1 | 1 | 0 | 1 | 0 | 7 |
| 20 | 28 | 0 | 0 | 0 | 0 | 0 | 1 | 1 | 1 | 0 | 0 | 8 |
| 21 | 28 | 0 | 0 | 0 | 0 | 0 | 1 | 1 | 1 | 0 | 0 | 7 |
| 22 | 28 | 0 | 0 | 0 | 0 | 0 | 1 | 1 | 1 | 0 | 0 | 6 |
| **23** | 29 | 0 | 0 | 0 | 0 | 0 | 1 | 1 | 1 | 0 | 1 | 6 |
| **24** | 30 | 0 | 0 | 0 | 0 | 0 | 1 | 1 | 1 | 1 | 0 | 6 |
| 25 | 30 | 0 | 0 | 0 | 0 | 0 | 1 | 1 | 1 | 1 | 0 | 5 |
| 26 | 30 | 0 | 0 | 0 | 0 | 0 | 1 | 1 | 1 | 1 | 0 | 4 |
| 27 | 30 | 0 | 0 | 0 | 0 | 0 | 1 | 1 | 1 | 1 | 0 | 3 |
| 28 | 30 | 0 | 0 | 0 | 0 | 0 | 1 | 1 | 1 | 1 | 0 | 2 |
| 29 | 30 | 0 | 0 | 0 | 0 | 0 | 1 | 1 | 1 | 1 | 0 | 1 |
| 30 | 30 | 0 | 0 | 0 | 0 | 0 | 1 | 1 | 1 | 1 | 0 | 0 |
| 31 | 46 | 0 | 0 | 0 | 0 | 1 | 0 | 1 | 1 | 1 | 0 | 15 |
| 32 | 47 | 0 | 0 | 0 | 0 | 1 | 0 | 1 | 1 | 1 | 1 | 15 |

FOURTH GRAY SCALE LEVEL

FOURTH EMISSION PATTERN

Fig. 8e

| GRAY SCALE LEVEL | FIRST GRAY SCALE VALUE | SECOND GRAY SCALE LEVEL | THIRD GRAY SCALE LEVEL | FOURTH GRAY SCALE LEVEL | AVERAGE VALUE | ERROR |
|---|---|---|---|---|---|---|
| 12 | 7 | 11 | 14 | 15 | 11.75 | 0.25 |
| 13 | 11 | 13 | 14 | 15 | 13.25 | -0.25 |
| 14 | 11 | 13 | 14 | 15 | 13.25 | 0.75 |
| 15 | 11 | 13 | 14 | 23 | 15.25 | -0.25 |
| 16 | 13 | 14 | 15 | 23 | 16.25 | -0.25 |
| 17 | 13 | 14 | 15 | 23 | 16.25 | 0.75 |
| 18 | 13 | 14 | 22 | 26 | 18.75 | -0.75 |
| 19 | 13 | 15 | 22 | 26 | 19 | 0.00 |
| 20 | 14 | 15 | 23 | 28 | 20 | 0.00 |
| 21 | 14 | 15 | 26 | 28 | 20.75 | 0.25 |
| 22 | 14 | 22 | 26 | 28 | 22.5 | -0.50 |
| 23 | 15 | 22 | 26 | 29 | 23 | 0.00 |
| 24 | 15 | 23 | 28 | 30 | 24 | 0.00 |
| 25 | 15 | 27 | 28 | 30 | 25 | 0.00 |
| 26 | 22 | 27 | 28 | 30 | 26.75 | -0.75 |
| 27 | 23 | 27 | 28 | 30 | 27 | 0.00 |
| 28 | 23 | 27 | 29 | 30 | 27.25 | 0.75 |
| 29 | 23 | 27 | 29 | 30 | 27.25 | 1.75 |
| 30 | 23 | 27 | 29 | 30 | 27.25 | 2.75 |
| 31 | 23 | 27 | 29 | 46 | 31.25 | -0.25 |
| 32 | 23 | 27 | 31 | 47 | 32 | 0.00 |

Fig. 10a

| GRAY SCALE LEVEL | SUB-FIELD | 10 | 9 | 8 | 7 | 6 | 5 | 4 | 3 | 2 | 1 | FIRST DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 10 | 0 | 0 | 0 | 0 | 0 | 0 | 1 | 0 | 1 | 0 | -2 |
| 13 | 10 | 0 | 0 | 0 | 0 | 0 | 0 | 1 | 0 | 1 | 0 | -3 |
| 14 | 11 | 0 | 0 | 0 | 0 | 0 | 0 | 1 | 0 | 1 | 1 | -3 |
| 15 | 11 | 0 | 0 | 0 | 0 | 0 | 0 | 1 | 0 | 1 | 1 | -4 |
| 16 | 13 | 0 | 0 | 0 | 0 | 0 | 0 | 1 | 1 | 0 | 1 | -3 |
| 17 | 13 | 0 | 0 | 0 | 0 | 0 | 0 | 1 | 1 | 0 | 1 | -4 |
| 18 | 14 | 0 | 0 | 0 | 0 | 0 | 0 | 1 | 1 | 1 | 0 | -4 |
| 19 | 14 | 0 | 0 | 0 | 0 | 0 | 0 | 1 | 1 | 1 | 0 | -5 |
| 20 | 14 | 0 | 0 | 0 | 0 | 0 | 0 | 1 | 1 | 1 | 0 | -6 |
| 21 | 15 | 0 | 0 | 0 | 0 | 0 | 0 | 1 | 1 | 1 | 1 | -6 |
| 22 | 15 | 0 | 0 | 0 | 0 | 0 | 0 | 1 | 1 | 1 | 1 | -7 |
| **23** | 21 | 0 | 0 | 0 | 0 | 0 | 1 | 0 | 1 | 0 | 1 | -2 |
| 24 | 21 | 0 | 0 | 0 | 0 | 0 | 1 | 0 | 1 | 0 | 1 | -3 |
| 25 | 22 | 0 | 0 | 0 | 0 | 0 | 1 | 0 | 1 | 1 | 0 | -3 |
| 26 | 22 | 0 | 0 | 0 | 0 | 0 | 1 | 0 | 1 | 1 | 0 | -4 |
| 27 | 23 | 0 | 0 | 0 | 0 | 0 | 1 | 0 | 1 | 1 | 1 | -4 |
| 28 | 26 | 0 | 0 | 0 | 0 | 0 | 1 | 1 | 0 | 1 | 0 | -2 |
| 29 | 26 | 0 | 0 | 0 | 0 | 0 | 1 | 1 | 0 | 1 | 0 | -3 |
| 30 | 27 | 0 | 0 | 0 | 0 | 0 | 1 | 1 | 0 | 1 | 1 | -3 |
| 31 | 27 | 0 | 0 | 0 | 0 | 0 | 1 | 1 | 0 | 1 | 1 | -4 |
| 32 | 27 | 0 | 0 | 0 | 0 | 0 | 1 | 1 | 0 | 1 | 1 | -5 |

FIRST GRAY SCALE VALUE

FIRST EMISSION PATTERN

Fig. 10b

| GRAY SCALE LEVEL | SUB-FIELD | 10 | 9 | 8 | 7 | 6 | 5 | 4 | 3 | 2 | 1 | SECOND DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 11 | 0 | 0 | 0 | 0 | 0 | 0 | 1 | 0 | 1 | 1 | -1 |
| 13 | 13 | 0 | 0 | 0 | 0 | 0 | 0 | 1 | 1 | 0 | 1 | 0 |
| 14 | 13 | 0 | 0 | 0 | 0 | 0 | 0 | 1 | 1 | 0 | 1 | -1 |
| 15 | 13 | 0 | 0 | 0 | 0 | 0 | 0 | 1 | 1 | 0 | 1 | -2 |
| 16 | 14 | 0 | 0 | 0 | 0 | 0 | 0 | 1 | 1 | 1 | 0 | -2 |
| 17 | 14 | 0 | 0 | 0 | 0 | 0 | 0 | 1 | 1 | 1 | 0 | -3 |
| 18 | 15 | 0 | 0 | 0 | 0 | 0 | 0 | 1 | 1 | 1 | 1 | -3 |
| 19 | 15 | 0 | 0 | 0 | 0 | 0 | 0 | 1 | 1 | 1 | 1 | -4 |
| 20 | 21 | 0 | 0 | 0 | 0 | 0 | 1 | 0 | 1 | 0 | 1 | 1 |
| 21 | 21 | 0 | 0 | 0 | 0 | 0 | 1 | 0 | 1 | 0 | 1 | 0 |
| 22 | 22 | 0 | 0 | 0 | 0 | 0 | 1 | 0 | 1 | 1 | 0 | 0 |
| **23** | 22 | 0 | 0 | 0 | 0 | 0 | 1 | 0 | 1 | 1 | 0 | -1 |
| 24 | 22 | 0 | 0 | 0 | 0 | 0 | 1 | 0 | 1 | 1 | 0 | -2 |
| 25 | 23 | 0 | 0 | 0 | 0 | 0 | 1 | 0 | 1 | 1 | 1 | -2 |
| 26 | 26 | 0 | 0 | 0 | 0 | 0 | 1 | 1 | 0 | 1 | 0 | 0 |
| 27 | 26 | 0 | 0 | 0 | 0 | 0 | 1 | 1 | 0 | 1 | 0 | -1 |
| 28 | 27 | 0 | 0 | 0 | 0 | 0 | 1 | 1 | 0 | 1 | 1 | -1 |
| 29 | 29 | 0 | 0 | 0 | 0 | 0 | 1 | 1 | 1 | 0 | 1 | 0 |
| 30 | 29 | 0 | 0 | 0 | 0 | 0 | 1 | 1 | 1 | 0 | 1 | -1 |
| 31 | 29 | 0 | 0 | 0 | 0 | 0 | 1 | 1 | 1 | 0 | 1 | -2 |
| 32 | 29 | 0 | 0 | 0 | 0 | 0 | 1 | 1 | 1 | 0 | 1 | -3 |

SECOND GRAY SCALE LEVEL

SECOND EMISSION PATTERN

Fig. 10c

| GRAY SCALE LEVEL | SUB-FIELD | 10 | 9 | 8 | 7 | 6 | 5 | 4 | 3 | 2 | 1 | THIRD DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 13 | 0 | 0 | 0 | 0 | 0 | 0 | 1 | 1 | 0 | 1 | 1 |
| 13 | 14 | 0 | 0 | 0 | 0 | 0 | 0 | 1 | 1 | 1 | 0 | 1 |
| 14 | 14 | 0 | 0 | 0 | 0 | 0 | 0 | 1 | 1 | 1 | 0 | 0 |
| 15 | 15 | 0 | 0 | 0 | 0 | 0 | 0 | 1 | 1 | 1 | 1 | 0 |
| 16 | 15 | 0 | 0 | 0 | 0 | 0 | 0 | 1 | 1 | 1 | 1 | -1 |
| 17 | 21 | 0 | 0 | 0 | 0 | 0 | 1 | 0 | 1 | 0 | 1 | 4 |
| 18 | 21 | 0 | 0 | 0 | 0 | 0 | 1 | 0 | 1 | 0 | 1 | 3 |
| 19 | 22 | 0 | 0 | 0 | 0 | 0 | 1 | 0 | 1 | 1 | 0 | 3 |
| 20 | 22 | 0 | 0 | 0 | 0 | 0 | 1 | 0 | 1 | 1 | 0 | 2 |
| 21 | 22 | 0 | 0 | 0 | 0 | 0 | 1 | 0 | 1 | 1 | 0 | 1 |
| 22 | 23 | 0 | 0 | 0 | 0 | 0 | 1 | 0 | 1 | 1 | 1 | 1 |
| **23** | 23 | 0 | 0 | 0 | 0 | 0 | 1 | 0 | 1 | 1 | 1 | 0 |
| 24 | 26 | 0 | 0 | 0 | 0 | 0 | 1 | 1 | 0 | 1 | 0 | 2 |
| 25 | 26 | 0 | 0 | 0 | 0 | 0 | 1 | 1 | 0 | 1 | 0 | 1 |
| 26 | 27 | 0 | 0 | 0 | 0 | 0 | 1 | 1 | 0 | 1 | 1 | 1 |
| 27 | 29 | 0 | 0 | 0 | 0 | 0 | 1 | 1 | 1 | 0 | 1 | 2 |
| 28 | 29 | 0 | 0 | 0 | 0 | 0 | 1 | 1 | 1 | 0 | 1 | 1 |
| 29 | 30 | 0 | 0 | 0 | 0 | 0 | 1 | 1 | 1 | 1 | 0 | 1 |
| 30 | 30 | 0 | 0 | 0 | 0 | 0 | 1 | 1 | 1 | 1 | 0 | 0 |
| 31 | 30 | 0 | 0 | 0 | 0 | 0 | 1 | 1 | 1 | 1 | 0 | -1 |
| 32 | 30 | 0 | 0 | 0 | 0 | 0 | 1 | 1 | 1 | 1 | 0 | -2 |

THIRD GRAY SCALE LEVEL

THIRD EMISSION PATTERN

Fig. 10d

| GRAY SCALE LEVEL | SUB-FIELD | 10 | 9 | 8 | 7 | 6 | 5 | 4 | 3 | 2 | 1 | FOURTH DITHER VALUE |
|---|---|---|---|---|---|---|---|---|---|---|---|---|
| | WEIGHT | 512 | 256 | 128 | 64 | 32 | 16 | 8 | 4 | 2 | 1 | |
| 12 | 14 | 0 | 0 | 0 | 0 | 0 | 0 | 1 | 1 | 1 | 0 | 2 |
| 13 | 15 | 0 | 0 | 0 | 0 | 0 | 0 | 1 | 1 | 1 | 1 | 2 |
| 14 | 21 | 0 | 0 | 0 | 0 | 0 | 1 | 0 | 1 | 0 | 1 | 7 |
| 15 | 21 | 0 | 0 | 0 | 0 | 0 | 1 | 0 | 1 | 0 | 1 | 6 |
| 16 | 22 | 0 | 0 | 0 | 0 | 0 | 1 | 0 | 1 | 1 | 0 | 6 |
| 17 | 22 | 0 | 0 | 0 | 0 | 0 | 1 | 0 | 1 | 1 | 0 | 5 |
| 18 | 22 | 0 | 0 | 0 | 0 | 0 | 1 | 0 | 1 | 1 | 0 | 4 |
| 19 | 23 | 0 | 0 | 0 | 0 | 0 | 1 | 0 | 1 | 1 | 1 | 4 |
| 20 | 23 | 0 | 0 | 0 | 0 | 0 | 1 | 0 | 1 | 1 | 1 | 3 |
| 21 | 26 | 0 | 0 | 0 | 0 | 0 | 1 | 1 | 0 | 1 | 0 | 5 |
| 22 | 26 | 0 | 0 | 0 | 0 | 0 | 1 | 1 | 0 | 1 | 0 | 4 |
| **23** | 26 | 0 | 0 | 0 | 0 | 0 | 1 | 1 | 0 | 1 | 0 | 3 |
| 24 | 27 | 0 | 0 | 0 | 0 | 0 | 1 | 1 | 0 | 1 | 1 | 3 |
| 25 | 29 | 0 | 0 | 0 | 0 | 0 | 1 | 1 | 1 | 0 | 1 | 4 |
| 26 | 29 | 0 | 0 | 0 | 0 | 0 | 1 | 1 | 1 | 0 | 1 | 3 |
| 27 | 30 | 0 | 0 | 0 | 0 | 0 | 1 | 1 | 1 | 1 | 0 | 3 |
| 28 | 30 | 0 | 0 | 0 | 0 | 0 | 1 | 1 | 1 | 1 | 0 | 2 |
| 29 | 31 | 0 | 0 | 0 | 0 | 0 | 1 | 1 | 1 | 1 | 1 | 2 |
| 30 | 31 | 0 | 0 | 0 | 0 | 0 | 1 | 1 | 1 | 1 | 1 | 1 |
| 31 | 31 | 0 | 0 | 0 | 0 | 0 | 1 | 1 | 1 | 1 | 1 | 0 |
| 32 | 42 | 0 | 0 | 0 | 0 | 1 | 0 | 1 | 0 | 1 | 0 | 10 |

FOURTH GRAY SCALE LEVEL

FOURTH EMISSION PATTERN

Fig. 10e

| GRAY SCALE LEVEL | FIRST GRAY SCALE VALUE | SECOND GRAY SCALE LEVEL | THIRD GRAY SCALE LEVEL | FOURTH GRAY SCALE LEVEL | AVERAGE VALUE | ERROR |
|---|---|---|---|---|---|---|
| 12 | 10 | 11 | 13 | 14 | 12 | 0.00 |
| 13 | 10 | 13 | 14 | 15 | 13 | 0.00 |
| 14 | 11 | 13 | 14 | 21 | 14.75 | -0.75 |
| 15 | 11 | 13 | 15 | 21 | 15 | 0.00 |
| 16 | 13 | 14 | 15 | 22 | 16 | 0.00 |
| 17 | 13 | 14 | 21 | 22 | 17.5 | -0.50 |
| 18 | 14 | 15 | 21 | 22 | 18 | 0.00 |
| 19 | 14 | 15 | 22 | 23 | 18.5 | 0.50 |
| 20 | 14 | 21 | 22 | 23 | 20 | 0.00 |
| 21 | 15 | 21 | 22 | 26 | 21 | 0.00 |
| 22 | 15 | 22 | 23 | 26 | 21.5 | 0.50 |
| 23 | 21 | 22 | 23 | 26 | 23 | 0.00 |
| 24 | 21 | 22 | 26 | 27 | 24 | 0.00 |
| 25 | 22 | 23 | 26 | 29 | 25 | 0.00 |
| 26 | 22 | 26 | 27 | 29 | 26 | 0.00 |
| 27 | 23 | 26 | 29 | 30 | 27 | 0.00 |
| 28 | 26 | 27 | 29 | 30 | 28 | 0.00 |
| 29 | 26 | 29 | 30 | 31 | 29 | 0.00 |
| 30 | 27 | 29 | 30 | 31 | 29.25 | 0.75 |
| 31 | 27 | 29 | 30 | 31 | 29.25 | 1.75 |
| 32 | 27 | 29 | 30 | 42 | 32 | 0.00 |

DISPLAY UNIT AND DISPLAY METHOD

TECHNICAL FIELD

The present invention relates to display apparatuses and a display method for providing a grayscale display using a sub-field method.

BACKGROUND ART

Plasma display apparatuses using plasma display panels as self-emission image displays have the advantage that thinning and larger screens are possible. Such a plasma display apparatus displays images by utilizing light emissions at the time of discharges of discharge cells forming pixels. Since a plasma display panel emits light in binary form, a sub-field method is used for the plasma display panel by which a halftone is displayed by temporally superimposing a plurality of binary images that are each weighted.

In the above-mentioned sub-field method, a single field is temporally divided into a plurality of sub-fields that are each weighted. The weight of each sub-field corresponds to the amount of emission for each sub-field. For example, the number of emissions is used as the weight, and the sum of the weights of all the sub-fields corresponds to the brightness, or the grayscale level of a video signal.

This sub-field method has a fixed order of emissions for the plurality of sub-fields. Therefore, when a viewer of emitting sub-fields moves his or her eye on a plurality of pixels, the viewer will see a different sub-field for each pixel. This causes the viewer to see a grayscale level that is considerably different from the grayscale level that should have been represented. In particular, if adjacent pixels are consecutive, the viewer visually perceives a striped false contour which seems as if the grayscale level had been lost. Such a false contour is known to degrade display quality very much. This false contour appearing only with moving images is referred to as a "false contour noise" (Institute of Television Engineers of Japan Technical Report. "False Contour Noise Observed in Display of Pulse Width Modulated Moving Images", Vol. 19, No. 2, IDY 95-21, pp. 61-66).

FIG. 11 is a schematic diagram for illustrating a false contour noise that is visually perceived by a human eye moving on different pixels.

In FIG. 11, the white circles denote emission sub-fields, the black circles denote non-emission sub-fields, and the plurality of sub-fields are denoted as SF1 to SF10 in order of smaller weight. The rows A, B, C, D shown in FIG. 11 denote the numbers of pixel rows in the horizontal direction, and the column 1 denotes the number of a pixel column in the vertical direction.

In FIG. 11, when the human eye is fixed in the row A column 1 position or the row B column 1 position, the eye perceives the sub-fields SF1-SF10 for the pixel arranged in the row A column 1 or the sub-fields SF1-SF10 for the pixel arranged in the row B column 1. In this case, the emission patterns for these pixels are "1101110111" and "0111011111", respectively, while the grayscale values perceived by the eye are "955" and "1006", respectively. In this way, the grayscale value of the pixel arranged in the row A column 1 is originally perceived to be lower than the grayscale value of the pixel in the row B column 1.

When the sight of line I1 of a human moves from the pixel in the row A column 1 to the pixel in the row C column 1 as denoted by the solid arrow in FIG. 11, the eye perceives the sub-fields SF1-SF3 for the pixel in the row A column 1, the sub-fields SF4-SF8 for the pixel in the row B column 1, and the sub-fields SF9, SF10 for the pixel in row C column 1 in order. In this case, the emission pattern is "1101011111", while the grayscale value that is perceived by the eye is "1003".

Similarly, when the line of sight I2 of a human moves from the pixel in the row B column 1 to the pixel in the row D column 1 as denoted by the dotted arrow in FIG. 11, the eye perceives the sub-fields SF1-SF3 for the pixel in the row B column 1, the sub-fields SF4-SF8 for the pixel in the row C column 1, and the sub-fields SF9, SF10 for the pixel in the row D column 1 in order. In this case, the emission pattern is "0111110111", while the grayscale value that is perceived by the eye is "956".

In this way, because of the motion of the sight of line I1, the grayscale value is perceived as "1003" which is higher than the grayscale value "955" that should have originally been represented. Also, because of the motion of the line of sight I2, the grayscale value is perceived as "956" which is lower than the grayscale value "1006" that should have originally been represented. The relation between each adjacent pixels in the row 1 is thus reversed by the motion of the line of sight. Such changes in the grayscale values of pixels are perceived as false contour noises.

In one suggested method for reducing false contour noises, grayscale levels for which emission sub-fields are continuously present are selected as grayscale levels unlikely to cause a false contour noise, and only the selected grayscale levels are used for display. In this case, a grayscale level other than the selected ones can be represented by selecting two of grayscale levels between this grayscale level that are unlikely to cause a false contour noise, and displaying the two grayscale levels alternately for each field (refer to e.g. JP 2000-276100 A).

Another method for reducing false contour noises involves decreasing the number of sub-fields to reduce the generation of a false contour noise. In this case, in order to represent grayscale levels that cannot be represented due to the decreased number of sub-fields, four pixels that are vertically and horizontally adjacent to one other are assumed as a single set, and four dither coefficients different from one another are assigned and added to respective pixel data corresponding to the pixels of this set. This allows representation of the foregoing grayscale levels that could not be represented through an area ratio grayscale. The method also achieves reduction of noise due to dither patterns by varying the dither coefficient that is added for each field (refer to e.g. JP 10-98663 A).

However, with the above-described methods for reducing false contour noises, degradation of image quality occurs due to decreased number of grayscale levels that can be represented.

DISCLOSURE OF INVENTION

An object of the present invention is to provide a display apparatus and a display method that allow false contour noises to be reduced without degrading image quality.

Another object of the present invention is to provide a display apparatus and a display method that allow false contour noises to be efficiently reduced based on the degree of false contour noise generation.

According to one aspect of the present invention, there is provided a display apparatus for providing a grayscale display based on a video signal with a grayscale level using a sub-field method, comprising a display panel that is composed of a plurality of areas each including first, second, third, and fourth pixels that are vertically and horizontally adjacent to one another, and a grayscale display unit that stores first, second, third, and fourth tables that include a plurality of first, second, third, and fourth emission patterns corresponding to the respective first, second, third, and fourth pixels in each area, and selects first, second, third, and fourth emission patterns corresponding to the first, second, third, and fourth pixels, respectively, from the first, second, third, and fourth tables based on the grayscale level of the video signal, so as to provide a grayscale display by causing the first, second, third, and fourth pixels in each area of the display panel to emit light or not for each sub-field based on the selected first, second, third, and fourth emission patterns, wherein combination patterns of emissions and non-emissions in predetermined sub-fields of the plurality of sub-fields are different among the first, second, third, and fourth emission patterns, the first pixel and the second pixel are arranged in one diagonal positions while the third pixel and the fourth pixel are arranged in another diagonal positions in each area, and for each grayscale level, a grayscale value represented by each of the first emission pattern and the second emission pattern is lower than an average of grayscale values represented by the first, second, third, and fourth emission patterns, while a grayscale value represented by each of the third emission pattern and the fourth emission pattern is higher than the average.

In the display apparatus according to the invention, the display panel is composed of a plurality of areas each including first, second, third, and fourth pixels that are vertically and horizontally adjacent to one another. In each area, the first pixel and the second pixel are arranged in one diagonal positions, while the third pixel and the fourth pixel are arranged in the other diagonal positions.

In addition, the first, second, third, and fourth tables are stored that include a plurality of first, second, third, and fourth emission patterns corresponding to the first, second, third, and fourth pixels, respectively. Based on the grayscale level of the video signal, first, second, third, and fourth emission patterns corresponding to the respective first, second, third, and fourth pixels in each area are selected from the first, second, third, and fourth tables. Based on the respective first, second, third, and fourth emission patterns selected, the first, second, third, and fourth pixels in each area of the display panel are caused to emit light or not for each sub-field. This results in a grayscale display.

In this case, the combination patterns of emissions and non-emissions in the predetermined sub-fields of the plurality of sub-fields are different among the first, second, third, and fourth emission patterns, so that the grayscale values of the first pixel to the fourth pixel represented based on the first emission pattern to the fourth emission pattern are different from one another. The grayscale of each area is represented as the average of the grayscale values of the first pixel to the fourth pixel.

In particular, using sub-fields unlikely to cause a false contour noise as the predetermined sub-fields, false contour noises can be reduced.

In whichever direction an eye may move, changes in the grayscale values of the first pixel to the fourth pixel cancel out one another. Consequently, changes in the perceived pixel values are not perceived as a false contour noise.

As a result of the foregoing, false contour noises can be reduced without degrading image quality.

The plurality of sub-fields may have different weights from one another, and the predetermined sub-fields may include, from a sub-field with the maximum weight to a sub-field with the minimum weight arranged in order of decreasing weight, a predetermined number of sub-fields starting from a sub-field with the greatest weight of the sub-fields in which a pixel emit light.

In this case, sub-fields that may affect the represented grayscale values most are used as the predetermined sub-fields, so that the effect of reducing false contour noises is increased. Moreover, the predetermined sub-fields are set using only the sub-fields with great weights which are likely to cause a false contour noise, thus leading to a decrease in the design steps.

In two or more emission patterns of the first, second, third, and fourth emission patterns, the combination patterns of the predetermined sub-fields may be the same between adjacent grayscale levels.

In this case, the combination patterns of the predetermined sub-fields are the same between adjacent grayscale levels, which allows false contour noises and noise due to dither patterns to be reduced.

The display apparatus may further comprise a detector that detects a degree of a false contour noise in an image displayed on the display panel, wherein the grayscale display unit may further store fifth, sixth, seventh, and eighth tables that include a plurality of fifth, sixth, seventh, and eighth emission patterns corresponding to the first, second, third, and fourth pixels, respectively, and selects either of a set of the first table to the fourth table or a set of the fifth table to the eighth table based on a result of detection by the detector, and when selecting the set of the fifth table to the eighth table, the grayscale display unit selects fifth, sixth, seventh, and eighth emission patterns corresponding to the respective first, second, third, and fourth pixels in each area from the selected fifth, sixth, seventh, and eighth emission patterns based on the grayscale level of the video signal, so as to provide a grayscale display by causing the first, second, third, and fourth pixels to emit light or not in each area of the display panel for each sub-field based on the selected fifth, sixth, seventh, and eighth emission patterns, and wherein some of combination patterns of emissions and non-emissions in the predetermined sub-fields may be the same among the fifth, sixth, seventh, and eighth emission patterns, and for each grayscale level, a grayscale value represented by each of the fifth emission pattern and the sixth emission pattern may be lower than an average of grayscale values represented by the fifth, sixth, seventh, and eighth emission patterns, while a grayscale value represented by each of the seventh emission pattern and the eighth emission pattern may be higher than the average.

In this case, the degree of the false contour noise in an image displayed on the display panel is detected.

In addition, the fifth, sixth, seventh, and eighth tables are stored that include a plurality of fifth, sixth, seventh, and eighth emission patterns corresponding to the first, second, third, and fourth pixels, respectively. Either of the set of the first table to the fourth table or the set of the fifth table to the eighth table are selected based on the result of detection. When the set of the fifth table to the eighth table is selected, fifth, sixth, seventh, and eighth emission patterns corresponding to the respective first, second, third, and fourth pixels in each area are selected based on the grayscale level of the video signal from the selected fifth, sixth, seventh, and eighth tables. Based on the selected fifth, sixth, seventh, and eighth emission patterns, the first, second, third, and fourth pixels in each area of the display panel are caused to emit light or not for each sub-field. This results in a gray scale display.

The grayscale of each area is represented as the average of the grayscale values of the first pixel to the fourth pixel. As in the case of using the first emission patterns to the fourth emission patterns, for each grayscale level, the grayscale value represented by each of the fifth emission pattern and the sixth emission pattern is lower than the average of the grayscales represented by the fifth emission pattern to the eighth emission pattern, while the grayscale value represented by each of the seventh emission pattern and the eighth emission pattern is higher than the average. This cancels out a false contour noise.

Note in particular that some of the combination patterns of emissions and non-emissions in the predetermined sub-fields are the same among the fifth emission patterns to the eighth emission patterns. This allows noise due to dither patterns to be reduced, even though the effect of false contour noise reduction is less than using the first emission patterns to the fourth emission patterns.

Using selectively the first emission patterns to the fourth emission patterns or the fifth emission patterns to the eighth emission patterns according to the degree of the false contour noise, noise due to dither patterns can be minimized while false contour noises can be reduced.

The grayscale display unit may include a dither value generator that stores differences between each grayscale level and grayscale values represented by the respective first, second, third, and fourth emission patterns as first, second, third, and fourth dither values, and outputs first, second, third, and fourth dither values corresponding to the grayscale level of the video signal, a coefficient adder that adds each of the first, second, third, and fourth dither values generated by the dither value generator to the grayscale level of the video signal, and a driver that stores the first, second, third, and fourth tables, and selects first, second, third, and fourth emission patterns from the first, second, third, and fourth tables based on the result of addition by the coefficient adder, so as to cause the first, second, third, and fourth pixels in each area of the display panel to emit light or not for each sub-field based on the selected first, second, third, and fourth emission patterns.

In this case, the differences between each grayscale level and the grayscale values represented by the respective first, second, third, and fourth emission patterns are stored as the first, second, third, and fourth dither values, and first, second, third, and fourth dither values corresponding to the grayscale level of the video signal are output. Each of the first, second, third, and fourth dither values is added to the grayscale level of the video signal. The first, second, third, and fourth tables are stored, and first, second, third, and fourth emission patterns are selected from the respective first, second, third, and fourth tables based on the result of addition. The first, second, third, and fourth pixels in each area of the display panel are caused to emit light or not for each sub-field based on the selected first, second, third, and fourth emission patterns.

In this way, grayscale is displayed using the first dither values to the fourth dither values while false contour noises are reduced.

The display apparatus may further comprise a diffusion device that diffuses spatially and/or temporally an error between the grayscale level of the video signal and the average of the grayscale values represented by the respective first, second, third, and fourth emission patterns to the video signal when the grayscale level of the video signal and the average of the grayscale values represented by the respective first, second, third, and fourth emission patterns are different.

In this case, when the grayscale level of the video signal and the average of the grayscales represented by the respective first, second, third, and fourth emission patterns are different, the error between the grayscale level of the video signal and the average of the grayscales represented by the respective first, second, third, and fourth emission patterns is spatially and/or temporally diffused to the video signal. This allows representation of the grayscale value corresponding to the grayscale level of the video signal.

According to another aspect of the invention, there is provided a display method for displaying grayscale on a display panel based on a video signal with a grayscale level using a sub-field method, the display panel being composed of a plurality of areas each including first, second, third, and fourth pixels that are vertically and horizontally adjacent to one another, the first pixel and the second pixel being arranged in one diagonal positions while the third pixel and the fourth pixel being arranged in another diagonal positions in each area, the method comprising the steps of storing first, second, third, and fourth tables that include a plurality of first, second, third, and fourth emission patterns corresponding to the first, second, third, and fourth pixels, respectively; selecting first, second, third, and fourth emission patterns corresponding to the respective first, second, third, and fourth pixels in each area from the first, second, third, and fourth tables based on the grayscale level of the video signal; and displaying grayscale by causing the first, second, third, and fourth pixels in each area of the display panel to emit light or not for each sub-field based on the selected first, second, third, and fourth emission patterns, wherein combination patterns of emissions and non-emissions in predetermined sub-fields of the plurality of sub-fields are different among the first, second, third, and fourth emission patterns, and for each grayscale level, a grayscale value represented by each of the first emission pattern and the second emission pattern is lower than an average of grayscale values represented by the first, second, third, and fourth emission patterns, while a grayscale value represented by each of the third emission pattern and the fourth emission pattern is higher than the average.

In the display method according to the invention, the display panel is composed of a plurality of areas each including first, second, third, and fourth pixels that are vertically and horizontally adjacent to one another. In each area, the first pixel and the second pixel are arranged in one diagonal positions while the third pixel and the fourth pixel are arranged in the other diagonal positions.

In addition, the first, second, third, and fourth tables are stored that include a plurality of first, second, third, and fourth emission patterns corresponding to the first, second, third, and fourth pixels, respectively. Based on the grayscale level of the video signal, first, second, third, and fourth emission patterns corresponding to the respective first, second, third, and fourth pixels in each area are selected from the first, second, third, and fourth tables. Based on the respective first, second, third, and fourth emission patterns selected, the first, second, third, and fourth pixels in each area of the display panel are caused to emit light or not for each sub-field. This results in a grayscale display.

In this case, the combination patterns of emissions and non-emissions in the predetermined sub-fields of the plurality of sub-fields are different among the first, second, third, and fourth emission patterns, so that the grayscale values of the first pixel to the fourth pixel represented based on the first emission pattern to the fourth emission pattern are different from one another. The grayscale of each area is represented as the average of the grayscale values of the first pixel to the fourth pixel.

In particular, using sub-fields unlikely to cause a false contour noise as the predetermined sub-fields, false contour noises can be reduced.

In whichever direction an eye may move, changes in the grayscale values of the first pixel to the fourth pixel cancel out one another. Consequently, changes in the perceived pixel values are not perceived as false contour noises.

As a result of the foregoing, false contour noises can be reduced without degrading image quality.

The plurality of sub-fields may have different weights from one another, and the predetermined sub-fields may include, from a sub-field with the maximum weight to a sub-field with the minimum weight arranged in order of decreasing weight, a predetermined number of sub-fields starting from a sub-field with the greatest weight of the sub-fields in which a pixel emit light.

In this case, sub-fields that may affect the represented grayscale values most are used as the predetermined sub-fields, so that the effect of reducing false contour noises are increased. Moreover, the predetermined sub-fields are set using only the sub-fields with great weights which are likely to cause a false contour noise, thus leading to a decrease in the design steps.

In two or more emission patterns of the first, second, third, and fourth emission patterns, the combination patterns of the predetermined sub-fields may be the same between adjacent grayscale levels.

In this case, the combination patterns of the predetermined sub-fields are the same between adjacent grayscale levels, which allows false contour noises and noises due to dither patterns to be reduced.

The display method may further comprise the steps of detecting a degree of a false contour noise in an image displayed by the display panel; storing fifth, sixth, seventh, and eighth tables that include a plurality of fifth, sixth, seventh, and eighth emission patterns corresponding to the first, second, third, and fourth pixels, respectively; selecting either of a set of the first table to the fourth table or a set of the fifth table to the eighth table based on the result of detection of the degree of a false contour noise; when the set of the fifth table to the eighth table is selected, selecting fifth, sixth, seventh, and eighth emission patterns corresponding to the respective first, second, third, and fourth pixels in each area from the selected fifth, sixth, seventh, and eighth tables based on the grayscale level of the video signal; and displaying grayscale by causing the first, second, third, and fourth pixels in each area of the display panel to emit light or not for each sub-field based on the selected fifth, sixth, seventh, and eighth tables, wherein some of combination patterns of emissions and non-emissions in the predetermined sub-fields may be the same among the fifth, sixth, seventh, and eighth emission patterns, and for each grayscale level, a grayscale value represented by each of the fifth emission pattern and the sixth emission pattern may be lower than an average of grayscale values represented by the fifth, sixth, seventh, and eighth emission patterns, while a grayscale value represented by each of the seventh emission pattern and the eighth emission pattern may be higher than the average.

In this case, the degree of the false contour noise in an image displayed on the display panel is detected.

In addition, the fifth, sixth, seventh, and eighth tables are stored that include a plurality of fifth, sixth, seventh, and eighth emission patterns corresponding to the first, second, third, and fourth pixels, respectively. Either of the set of the first table to the fourth table or the set of the fifth table to the eighth table are selected based on the result of detection. When the set of the fifth table to the eighth table is selected, fifth, sixth, seventh, and eighth emission patterns corresponding to the respective first, second, third, and fourth pixels in each area are selected based on the grayscale level of the video signal from the selected fifth, sixth, seventh, and eighth tables. Based on the selected fifth, sixth, seventh, and eighth emission patterns, the first, second, third, and fourth pixels in each area of the display panel are caused to emit light or not for each sub-field. This results in a gray scale display.

The grayscale of each area is represented as the average of the grayscale values of the first pixel to the fourth pixel. As in the case of using the first emission patterns to the fourth emission patterns, for each grayscale level, the grayscale value represented by each of the fifth emission pattern and sixth emission pattern is lower than the average of the grayscales represented by the fifth emission pattern to the eighth emission pattern, while the grayscale value represented by each of the seventh emission pattern and eighth emission pattern is higher than the average. This cancels out a false contour noise.

Note in particular that some of the combination patterns of emissions and non-emissions in the predetermined sub-fields are the same among the fifth emission patterns to the eighth emission patterns. This allows noise due to dither patterns to be reduced, even though the effect of false contour noise reduction is less than using the first emission patterns to the fourth emission patterns.

Using selectively the first emission patterns to the fourth emission patterns or the fifth emission patterns to the eighth emission patterns according to the degree of a false contour noise, noises due to dither patterns can be minimized while false contour noises can be reduced.

The step of displaying grayscale may include the steps of storing differences between each grayscale level and grayscale values represented by the respective first, second, third, and fourth emission patterns as first, second, third, and fourth dither values; outputting first, second, third, and fourth dither values corresponding to the grayscale level of the video signal; adding each of the generated first, second, third, and fourth dither values to the grayscale level of the video signal; storing the first, second, third, and fourth tables; selecting first, second, third, and fourth emission patterns from the first, second, third, and fourth tables based on the result of addition; and causing the first, second, third, and fourth pixels in each area of the display to emit light or not for each sub-field based on the selected first, second, third, and fourth emission patterns.

In this case, the differences between each grayscale level and the grayscale values represented by the respective first, second, third, and fourth emission patterns are stored as the first, second, third, and fourth dither values, and first, second, third, and fourth dither values corresponding to the grayscale level of the video signal are output. Each of the first, second, third, and fourth dither values is added to the grayscale level of the video signal. The first, second, third, and fourth tables are stored, and first, second, third, and fourth emission patterns are selected from the respective first, second, third, and fourth tables based on the result of addition. The first, second, third, and fourth pixels in each area of the display panel are caused to emit light or not for each sub-field based on the selected first, second, third, and fourth emission patterns.

In this way, grayscale is displayed using the first dither values to the fourth dither values while false contour noises are reduced.

The display method may further comprise the step of diffusing spatially and/or temporally an error between the grayscale level of the video signal and the average of the grayscale values represented by the respective first, second, third, and fourth emission patterns to the video signal when the grayscale level of the video signal and the average of the grayscale values represented by the respective first, second, third, and fourth emission patterns are different.

In this case, when the grayscale level of the video signal and the average of the grayscale values represented by the respective first emission pattern to the fourth emission pattern are different, the error between the grayscale level of the video signal and the average of the grayscale values represented by the first emission pattern to the fourth emission pattern is temporally and/or spatially diffused to the video signal. This allows representation of the grayscale value corresponding to the grayscale level of the video signal.

BRIEF DESCRIPTION OF DRAWINGS

FIG. 4*a*, FIG. 4*b*, FIG. 4*c*, FIG. 4*d*, and FIG. 4*e* are diagrams each for illustrating a dither table of the dither value generator and an emission pattern table of the sub-field converter;

FIG. 8*a*, FIG. 8*b*, FIG. 8*c*, FIG. 8*d*, and FIG. 8*e* are diagrams each for illustrating another example of a dither table of the dither value generator and another example of an emission pattern table of the sub-field converter;

FIG. 10*a*, FIG. 10*b*, FIG. 10*c*, FIG. 10*d*, and FIG. 10*e* are diagrams each for illustrating a dither table of the second dither value generator and an emission pattern table of the sub-field converter.

BEST MODE FOR CARRYING OUT THE INVENTION

In the embodiments shown below, applications of the present invention to plasma display apparatuses having PDP's (Plasma Display Panels) as an example of display apparatuses will be described. A PDP is composed of a plurality of areas, each including vertically and horizontally adjacent four pixels.

In the specification, monochromatic displays using a single color will be described for the sake of simplicity. Note, however, that the present invention is similarly applicable to color displays using three colors of R (red), G (green), and B (blue).

Plasma displays according to embodiments of the present invention represent the grayscale level of an incoming video signal as an average of grayscale values that are displayed by the vertically and horizontally adjacent four pixels in each area of the PDP.

First Embodiment

Figure 1:
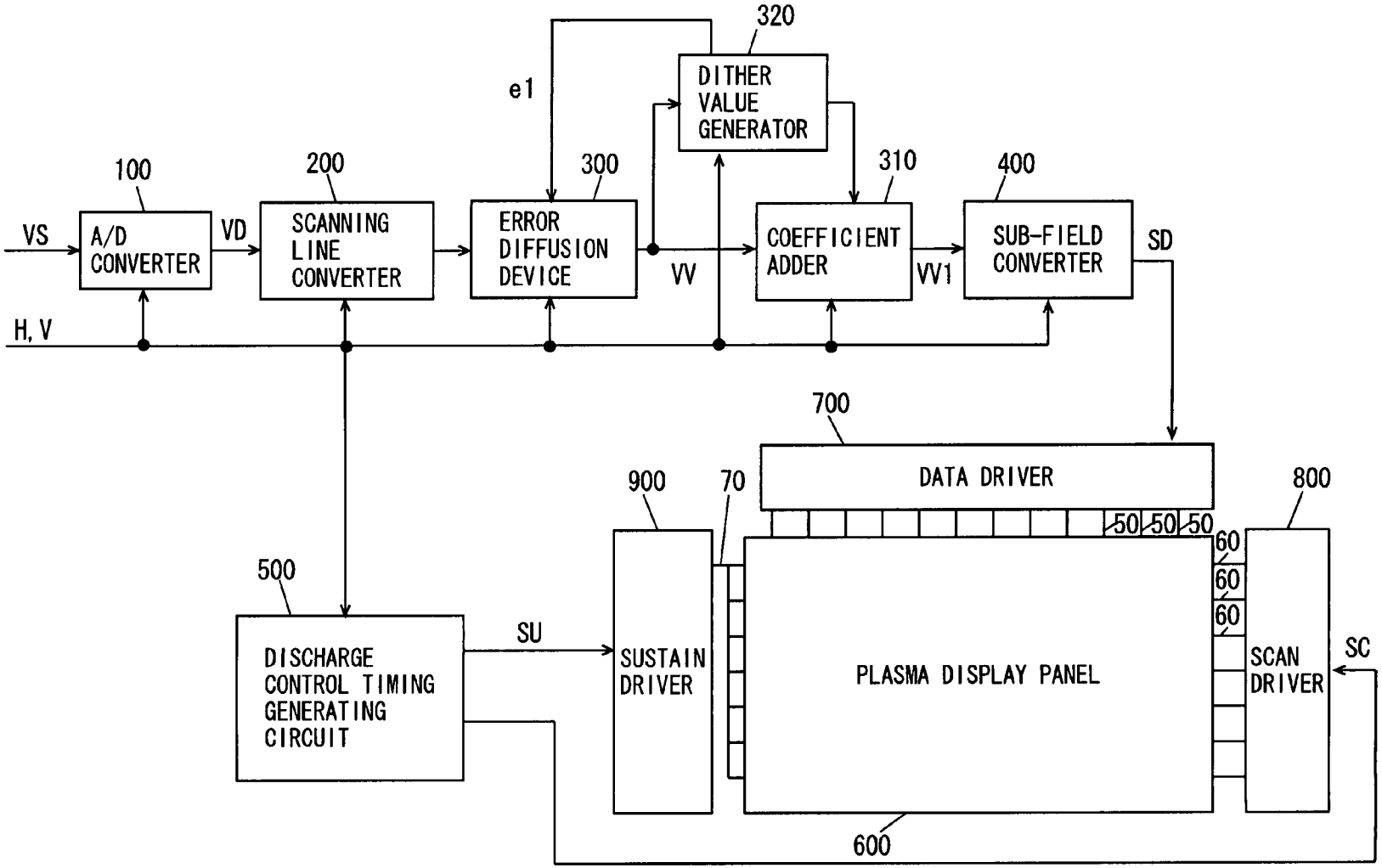
FIG. 1 is a block diagram showing the configuration of a plasma display apparatus according to a first embodiment of the invention.

FIG. 1 is a block diagram showing the configuration of a plasma display apparatus according to a first embodiment of the present invention.

The plasma display apparatus of FIG. 1 includes an A/D converter (analog-to-digital converter) 100, a scanning line converter 200, an error diffusion device 300, a coefficient adder 310, a dither value generator 320, a sub-field converter 400, a discharge control timing generating circuit 500, a PDP (Plasma Display Panel) 600, a data driver 700, a scan driver 800, and a sustain driver 900.

A video signal VS is input to the A/D converter 100. A horizontal synchronization signal H and a vertical synchronization signal V are supplied to the discharge control timing generating circuit 500, A/D converter 100, scanning line converter 200, error diffusion device 300, coefficient adder 310, dither value generator 320, and sub-field converter 400.

The A/D converter 100 converts the video signal VS to digital image data VD, and supplies the image data VD to the scanning line converter 200.

The scanning line converter 200 converts the image data VD to image data for the number of lines corresponding to the number of pixels of the PDP 600, and supplies the image data for each line to the error diffusion device 300. The image data for each line consists of a plurality of data corresponding to a plurality of pixels on each line.

The error diffusion device 300 diffuses spatially and temporally an error described below that is output from the dither device generator 320 described below. This will be discussed in detail below. Image data VV derived from the error diffusion device 300 is supplied to the coefficient adder 310 and the dither value generator 320. The value of the image data VV represents the grayscale level of corresponding pixels.

The dither value generator 320 stores dither tables that show relations between a plurality of grayscale levels represented by the image data VV and a plurality of dither values, and reads out dither values corresponding to the grayscale level of the image data VV from the dither tables, and supplies the dither values to the coefficient adder 310. As used herein, the dither value corresponds to a difference between each grayscale level and the grayscale value that is displayed by each pixel.

The coefficient adder 310 adds the dither values obtained from the dither value generator 320 to the image data VV obtained from the error diffusion device 300, and supplies the result of addition to the sub-field converter 400 as image data VV1.

The image data VV1 shows the grayscale values that are displayed by the respective four pixels in each area.

The sub-field converter 400 stores emission pattern tables that show relations between the grayscale values displayed by the respective four pixels in each area and the emission patterns of a plurality of sub-fields. In addition, the sub-field converter 400 converts, based on these emission pattern tables, the image data VV1 to serial data SD corresponding to the plurality of sub-fields, and supplies the serial data to the data driver 700.

The discharge control timing generating circuit 500 generates discharge control timing signals SC, SU with reference to the horizontal synchronization signal H and the vertical synchronization signal V. The discharge control timing generating circuit 500 supplies the discharge control timing signal SC to the scan driver 800 and the discharge control timing signal SU to the sustain driver 900.

The PDP 600 includes a plurality of data electrodes 50, a plurality of scan electrodes 60, and a plurality of sustain electrodes 70. The plurality of data electrodes 50 are vertically arranged on a screen, and the plurality of scan electrodes 60 and sustain electrodes 70 are horizontally arranged on the screen. The plurality of sustain electrodes 70 are commonly connected.

A discharge cell is formed at each intersection of a data electrode 50, a scan electrode 60, and a sustain electrode 70. Each discharge cell forms a pixel on the screen.

The data driver 700 converts the serial data SD obtained from the sub-field converter 400 to parallel data, and selectively supplies write pulses to the plurality of data electrodes 50 based on the parallel data.

The scan driver 800 drives each of the scan electrodes 60 based on the discharge control signal SC supplied from the discharge control timing generating circuit 500. The sustain driver 900 drives the sustain electrodes 70 based on the discharge control timing signal SU supplied from the discharge control timing generating circuit 500.

The plasma display apparatus shown in FIG. 1 employs an ADS (address display-period separation) system as a method for grayscale representation.

Figure 2:
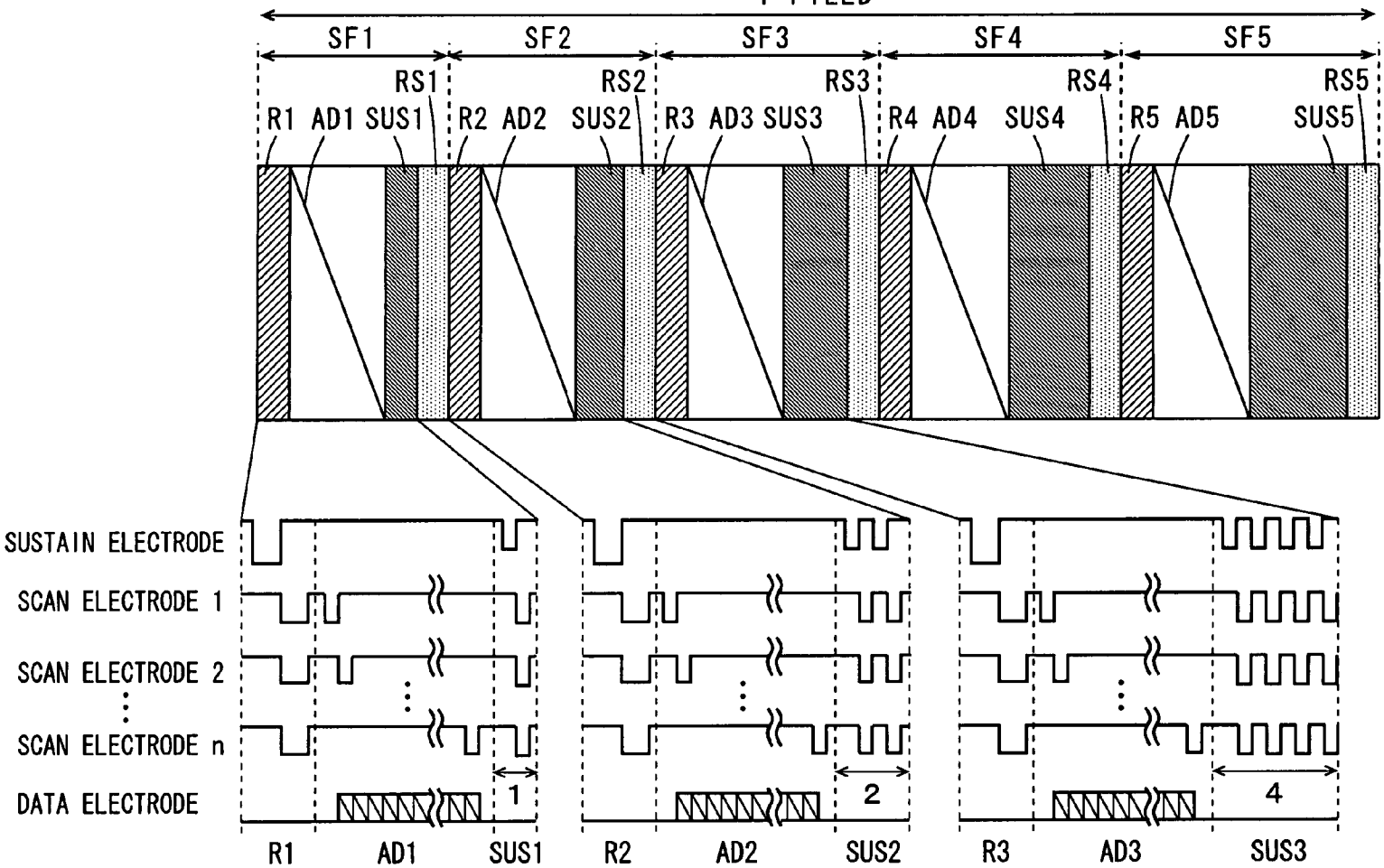
FIG. 2 is a diagram for illustrating an ADS system that is applied to the plasma display apparatus shown in FIG. 1.

FIG. 2 is a diagram for illustrating the ADS system that is applied to the plasma display apparatus shown in FIG. 1. Although FIG. 2 shows an example of negative pulses that cause discharges during the fall time of the drive pulses, basic operations shown below apply similarly to the case of positive pulses that cause discharges during the rise time. In FIG. 2, one field includes five sub-fields, SF1, SF2, SF3, SF4, SF5 for the sake of simplicity.

In the ADS system, one field is temporally divided into a plurality of sub-fields. In the example of FIG. 2, one field is divided into the five sub-fields SF1, SF2, SF3, SF4, SF5. The sub-fields SF1, SF2, SF3, SF4, SF5 are further separated into initialization periods R1-R5, write periods AD1-AD5, sustain periods SUS1-SUS5, and erase periods RS1-RS5, respectively. In each of the initialization periods R1-R5, the initialization process for each of the sub-fields is performed. In each of the write periods AD1-AD5, an address discharge is caused for selecting a discharge cell to be illuminated. In each of the sustain periods SUS1-SUS5, a sustain discharge is caused for display.

In each of the initialization periods R1-R5, a single initialization pulse is applied to the sustain electrodes 70, and a single initialization pulse is also applied to each scan electrode 60. This causes a preliminary discharge.

In each of the write periods AD1-AD5, the scan electrodes 60 are sequentially scanned, and a predetermined write process is applied only to a discharge cell among the data electrodes 50 that has received a write pulse. This causes an address discharge.

In each of the sustain periods SUS1 to SUS5, the number of sustain pulses corresponding to the weight that is set for each of the sub-fields SF1-SF5 are output to sustain electrodes 70 and scan electrodes 60. For example, in the sub-field SF1, one sustain pulse is applied to a sustain electrode 70, and one sustain pulse is applied to a scan electrode 60, and in the write period AD1, causing two sustain discharges in the selected discharge cells 14. In the sub-field SF2, two sustain pulses are applied to sustain electrodes 70, and two sustain pulses are applied to scan electrodes 60, and in the write period AD2, causing four sustain discharges in the selected discharge cells 14.

As described above, in the sub-fields SF1-SF5, one, two, four, eight, and sixteen sustain pulses, respectively, are applied to sustain electrodes 70 and scan electrodes 60, causing the discharge cells to emit light according to the brightnesses (luminancees) corresponding to the respective numbers of pulses. In other words, the sustain periods SUS1-SUS5 are periods in which the discharge cells selected in the respective write periods AD1-AD5 discharge the numbers of times corresponding to the respective weights of brightness.

Figure 3:
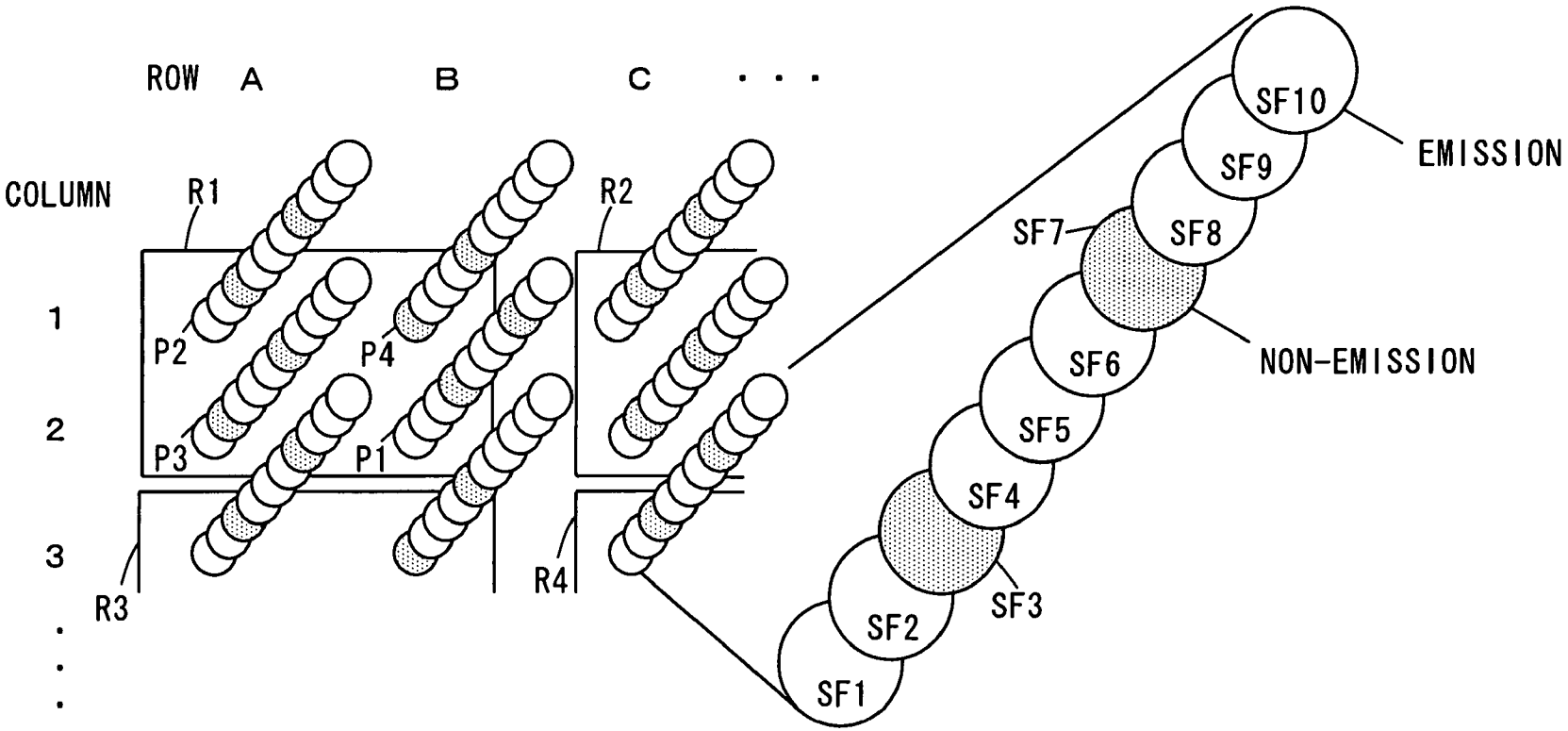
FIG. 3 is a schematic diagram showing an example of emission patterns of a plurality of sub-fields for the four pixels in each area which is based on the dither tables in the dither value generator.

FIG. 3 is a schematic diagram showing an example of emission patterns of a plurality of sub-fields for the four pixels of each area which is based on the dither tables in the dither value generator 320. In the example shown below, one field is divided into ten sub-fields.

In FIG. 3, the white circles denote emission sub-fields, the black circles denote non-emission sub-fields, and the plurality of sub-fields are denoted as SF1 to SF10 in order of smaller weight. The rows A, B, C, . . . shown in FIG. 3 denote the numbers of pixel rows in the horizontal direction, while the columns 1, 2, 3 . . . denote the numbers of pixel columns in the vertical direction. The areas of the PDP 600 are denoted as R1, R2, R3, R4, . . . .

The sub-fields SF1-SF10 are for use in representing the grayscale value of a pixel. For example, the weights of the sub-fields SF1, SF2, SF3, SF4, SF5, SF6, SF7, Sf8, SF9, SF10 are set to "1", "2", "4", "8", "16", "32", "64", "128", "256", and "512", respectively.

Now, grayscale displayed by the four pixels in the area R1 arranged in the row A column 1, row B column 1, row A column 2, and row B column 2, respectively, will be described. It is assumed that the grayscale level to be displayed by each of the four pixels in the region R1 is "959".

The pixel in the row B column 2 (lower right) is denoted as a first pixel P1, the pixel in the row A column 1 (upper left) is denoted as a second pixel P2, the pixel in the row A column 2 (lower left) is denoted as a third pixel P3, and the pixel in the row B column 1 (upper right) is denoted as a fourth pixel P4.

The emission pattern of the first pixel P1 is "1110111011" ("1" denoting emissions, "0" denoting non-emissions) in order from the sub-fields SF1-SF10, and represents a grayscale value of "887" in one field.

The emission pattern of the second pixel P2 is "1101110111" in order from the sub-fields SF1-SF10, and represents a grayscale value of "955" in one field.

The emission pattern of the third pixel P3 is "1011101111" in order from the sub-fields SF1-SF10, and represents a grayscale value of "989" in one field.

The emission pattern of the fourth pixel is "0111011111" in order from the sub-fields SF1-SF10, and represents a grayscale value of "1006" in one field.

The average of the grayscale values that are displayed by the above-mentioned first pixel P1 to the fourth pixel P4 is determined by (955+1006+989+887)/4, i.e., "959.25".

In this embodiment, the emission patterns of the above-mentioned first pixel P1 to the fourth pixel P4 in the sub-fields SF5-SF8 are set to "1101", "0111", "1011", "1110", respectively, such that they are different from one another.

In this embodiment, the emission patterns of the first pixel P1 to the fourth pixels P4 in the sub-fields SF5-SF8 are set to be different from one another. However, without being limited to such an example, the emission patterns in arbitrary n-th sub-field to m-th sub-field for the first pixel P1 to the fourth pixel P4 may be set differently from one another, where m and n are integers smaller than the total number of sub-fields, and m is greater than n.

Note that the difference between the grayscale level "959" to be displayed by each of the first pixel P1 to the fourth pixel P4 and the above-mentioned average "959.25" of the grayscale values of the first pixel P1 to the fourth pixel P4 that are actually represented by the emission patterns from the sub-fields SF1-SF10 is "−0.25"

The dither value generator 320 outputs this difference of "−0.25" to the error diffusion device 300 as an error of each of the first pixel P1 to the fourth pixel P4. The error diffusion device 300 diffuses this error spatially and temporally. The configuration of the error diffusion device 300 and a method of error diffusion will be discussed below.

As described above, in this embodiment, the emission patterns of the above-mentioned first pixel P1 to the fourth pixel P4 from the n-th sub-field to the m-th sub-field are different from one another (condition 1).

Moreover, in this embodiment, among the first pixel P1 to the fourth pixel P4 that are horizontally and vertically adjacent in each area of the PDP 600, the grayscale value displayed by each of the first pixel P1 and the second pixel P2 arranged in one diagonal positions is lower than the average of the grayscale values displayed by the above-mentioned first pixel P1 to fourth pixel P4. On the other hand, the grayscale value displayed by each of the third pixel P3 and the fourth pixel P4 arranged in the other diagonal positions is higher than the average of the grayscale values displayed by the above-mentioned first pixel P1 to fourth pixel P4 (condition 2).

In this embodiment, the emission patterns of the first pixel P1, second pixel P2, third pixel P3, and fourth pixel P4 in the sub-fields SF5-SF8 are set to be different from one another (as denoted by the thick lines in FIG. 4*a* to FIG. 4*d*). However, without being limited to such an example, the emission patterns of the above-mentioned first pixel P1 to the fourth pixel P4 from arbitrary n-th sub-field to m-th spb-field may be set differently from one another.

The combination patterns of emissions and non-emissions from the arbitrary n-th sub-field to the m-th sub-field are different among the emission patterns for the first pixel P1 to the fourth pixel P4, so that the grayscale values displayed by the first pixel P1 to the fourth pixel P4 based on their respective emission patterns are varied.

In addition, using the sub-fields unlikely to cause a false contour noise as arbitrary n-th sub-field to m-th sub-field, false contour noises can be reduced.

FIGS. 4*a*, 4*b*, 4*c*, 4*d* are diagrams each for illustrating the dither table of the dither value generator 320 and the emission pattern table of the sub-field converter 400.

The relations between the grayscale levels and the first dither values to the fourth dither values in FIG. 4*a* to 4*d* as well as the relations between the grayscale levels and the errors in FIG. 4*e* are included in the dither tables of the dither value generator 320. The dither value generator 320 determines to which of the first pixel P1 to the fourth pixel P4 the image data VV corresponds, based on the horizontal synchronization signal H and vertical synchronization signal V, and selects a dither value corresponding to the pixel.

On the other hand, the relations between the first grayscale values to the fourth grayscale values and the corresponding first emission patterns to the fourth emission patterns in FIG. 4*a* to FIG. 4*d* are included in the emission pattern table of the sub-field converter 400. The grayscale levels shown in FIG. 4*a*, FIG. 4*b*, FIG. 4*c*, FIG. 4*d* denote the grayscale levels of the first pixel P1, second pixel P2, third pixel P3, and fourth pixel P4, respectively.

Now, grayscale displayed by the first pixel P1 will be described when the grayscale level of the image data VV corresponding to the first pixel P1 is "959", for example.

As shown in FIG. 4 (*a*), when the image data VV with a grayscale level of "959" is input to the dither value generator 320, the dither value generator 320 outputs a first dither value "−72" to the coefficient adder 310 based on the dither table.

The coefficient adder 310 adds the first dither value "−72" to the grayscale level "959" of the image data VV, and outputs image data VV1 with a first grayscale value of "887" as a result of addition to the sub-field converter 400.

The sub-field converter 400 reads from the emission pattern table of FIG. 4*a* the first emission pattern "1110111011" corresponding to the first grayscale value "877"of the image data VV1, and converts it to serial data SD. Based on this serial data SD, a data electrode 50 corresponding to the first pixel P1 of the PDP 600 is driven by the data driver 700.

The second pixel P2, third pixel P3, and fourth pixel P4 also provide a grayscale display in a manner similar to the foregoing.

The dither value generator 320 further reads from the dither table of FIG. 4*e* an error of "−0.25" corresponding to the grayscale level "959" of the input image data VV, and outputs the error to the error diffusion device 300. In other words, the dither value generator 320 outputs the error "−0.25" to the error diffusion device 300 as a difference between the grayscale level "959" and the average "959.25" of the first grayscale value to the fourth grayscale value of the first pixel to the fourth pixel.

Next, description is given of how false contour noises are reduced by causing the first pixel P1 to the fourth pixel P4 to emit light or not based on the emission patterns that satisfy the above-mentioned condition 1 and condition 2 for the first pixel to the fourth pixel of each area in the PDP 600. A false contour noise is generated when the grayscale levels of adjacent pixels are the same or close.

Figure 5:
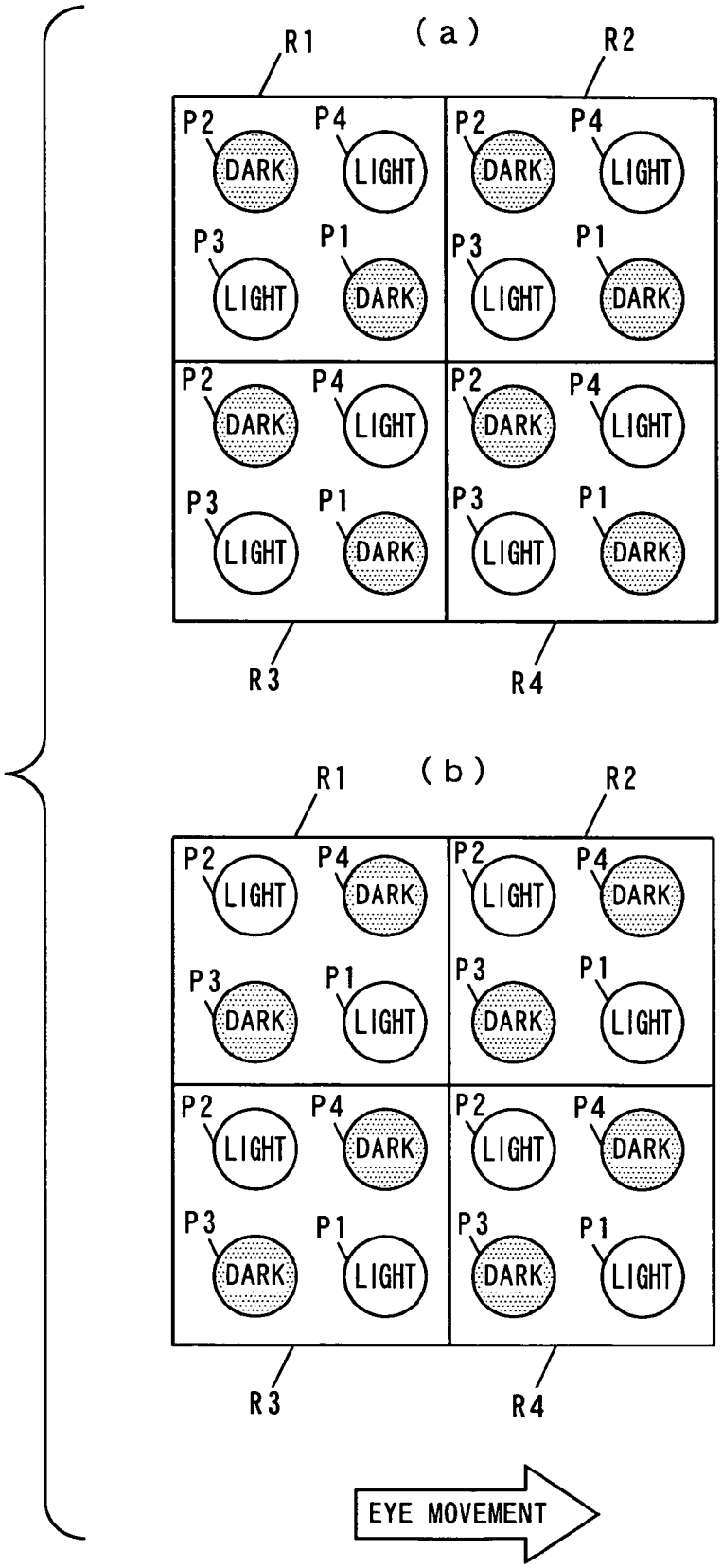
FIG. 5 (*a*) is a diagram for illustrating lights and darks of the respective pixels which are perceived by a human eye that is not moving, and FIG. 5 (*b*) is a diagram for illustrating lights and darks of the respective pixels which are perceived by a human eye moving in the direction of an arrow (from left to right)

FIG. 5 (*a*) is a diagram for illustrating the lights and darks of the respective pixels which are perceived by a human eye that is not moving. FIG. 5 (*b*) is a diagram for illustrating the lights and darks of the respective pixels which are perceived by a human eye moving in the direction of an arrow (from left to right).

In FIG. 5 (*a*) and FIG. 5 (*b*), pixels denoted as "lights" display grayscale values higher than the average of the grayscale values displayed by the first pixel P1 to the fourth pixel P4 in each area; whereas pixels denoted as "darks" display grayscale values lower than the average of the grayscale values displayed by the first pixel P1 to the fourth pixel P4 in each area.

As shown in FIG. 5 (*a*), the grayscale values of the first pixel P1 and the second pixel P2 of each of the areas R1, R2, R3, R4 in the PDP 600 are set lower than the average of the grayscale values of the first pixel P1 to the fourth pixel P4; while the grayscale values of the third pixel P3 and the fourth pixel P4 are set higher than the average of the grayscale values of the first pixel P1 to the fourth pixel P4.

More specifically, in this embodiment, assuming that the values of the first pixel P1, second pixel P2, third pixel P3, and fourth pixel P4 in each of the areas of R1, R2, R3, R4, . . . in the PDP 600 are p1, p2, p3, and p4, respectively, and the average of the grayscale values of the first pixel P1 to the fourth pixel P4 is pa, then the grayscale values of the first pixel P1 to the fourth pixel P4 are set so as to satisfy the equation shown below:

$$p1<p2<pa<p3<p4 \quad (1)$$

All of the areas in the PDP 600 have the relation of the equation (1) above.

On the other hand, when the human eye move in the direction of the arrow as shown in FIG. 5 (*b*), the grayscale values of the first pixel P1 and the second pixel P2 of each of the areas of R1, R2, R3, R4 in the PDP 600 are perceived to be higher than the average of the grayscale values of the first pixel P1 to the fourth pixel P4; while the grayscale values of the third pixel P3 and the fourth pixel P4 are perceived to be lower than the average of the grayscale values of the first pixel P1 to the fourth pixel P4.

In this way, the relation between the grayscale values of each adjacent pixels is reversed by the motion of an eye. However, changes in the grayscale values of the second pixel P2 and the third pixel P3 cancel each other out, while changes in the grayscale values of the first pixel P1 and the fourth pixel P4 cancel each other out. As a result, changes in the perceived pixel values are not perceived as false contour noises.

Moreover, when the human eye move in the direction from the second pixel P2 to the first pixel P1 (from upper left to lower right), the relation between the grayscale values of the first pixel P1 and the second pixel P2 in each of the areas R1, R2, R3, R4, . . . of PDP 600 is reversely perceived, while the relation between the grayscale values of the third pixel P3 and the fourth pixel P4 is reversely perceived.

In this way, the relation between the grayscale values of pixels adjacent in the diagonal direction is reversed by the motion of an eye in the diagonal direction. However, changes in the grayscale values of the second pixel P2 and the first pixel P1 cancel out each other, while changes in the grayscale values of the third pixel P3 and the fourth pixel P4 cancel out each other. As a result, changes in the perceived pixel values are not perceived as false contour noises.

Note that changes in the perceived pixel values are not perceived as false contour noises not only when an eye moves in the above-mentioned direction of the arrow (from right to left), but also in the direction opposite to the above-mentioned direction of the arrow, the direction from the second pixel P2 to the third pixel P3 and the direction from the fourth pixel P4 to the first pixel P1 (lower direction), the opposite direction thereto (upper direction), the direction from the first pixel P1 to the second pixel P2 (from lower right to upper left), the direction from the fourth pixel P4 to the third pixel P3 (from upper right to lower left), and the opposite direction thereto (from lower left to upper right).

This allows a decrease in false contour noises without degrading image quality.

Moreover, a human eye perceives grayscale values in an area composed of the first pixel P1 to the fourth pixel P4, so that degradation in image quality is prevented that is caused by e.g. a peculiar striped pattern observed when false contour noises are concentrated on a particular portion.

In the above-described example, the grayscale levels of the image data VV corresponding to the first pixel P1 to the fourth pixel P4 in each area are illustrated to be the same; however, the grayscale levels of the image data VV corresponding to the first pixel P1 to the fourth pixel P4 may not necessarily be the same. Even when the grayscale levels of the image data VV corresponding to the first pixel P1 to the fourth pixel P4 in each area are different from one another, an emission pattern table is set so as to satisfy the equation (1) shown above, if the grayscale levels of these pixels are close (when the difference between grayscale levels is one or two, for example). Note that the relation of the equation (1) shown above does not hold when the grayscale levels of the image data VV corresponding to the first pixel P1 to the fourth pixel P4 in each area are greatly different from one another. This is no problem, however, since a false contour noise is not generated when the grayscale levels to be displayed by the first pixel P1 to the fourth pixel P4 in each area are greatly different.

In this embodiment, the first pixel P1 and the second pixel P2 in each area are described to display grayscale values lower than the average of the grayscale values displayed by the first pixel P1 to the fourth pixel P4, while the third pixel P3 and the fourth pixel P4 in each area are described to display grayscale levels higher than the average. However, without being limited to such an example, the first pixel P1 and the second pixel P2 in each area may be described to display grayscale values higher than the average of the grayscale values displayed by the first pixel P1 to the fourth pixel, while the third pixel P3 and the fourth pixel P4 in each area may be described to display grayscale values lower than the average.

Next, the error diffusion device 300 will be described that spatially and temporally diffuses an error e1 that is outputted from the dither value generator 320.

Figure 6:
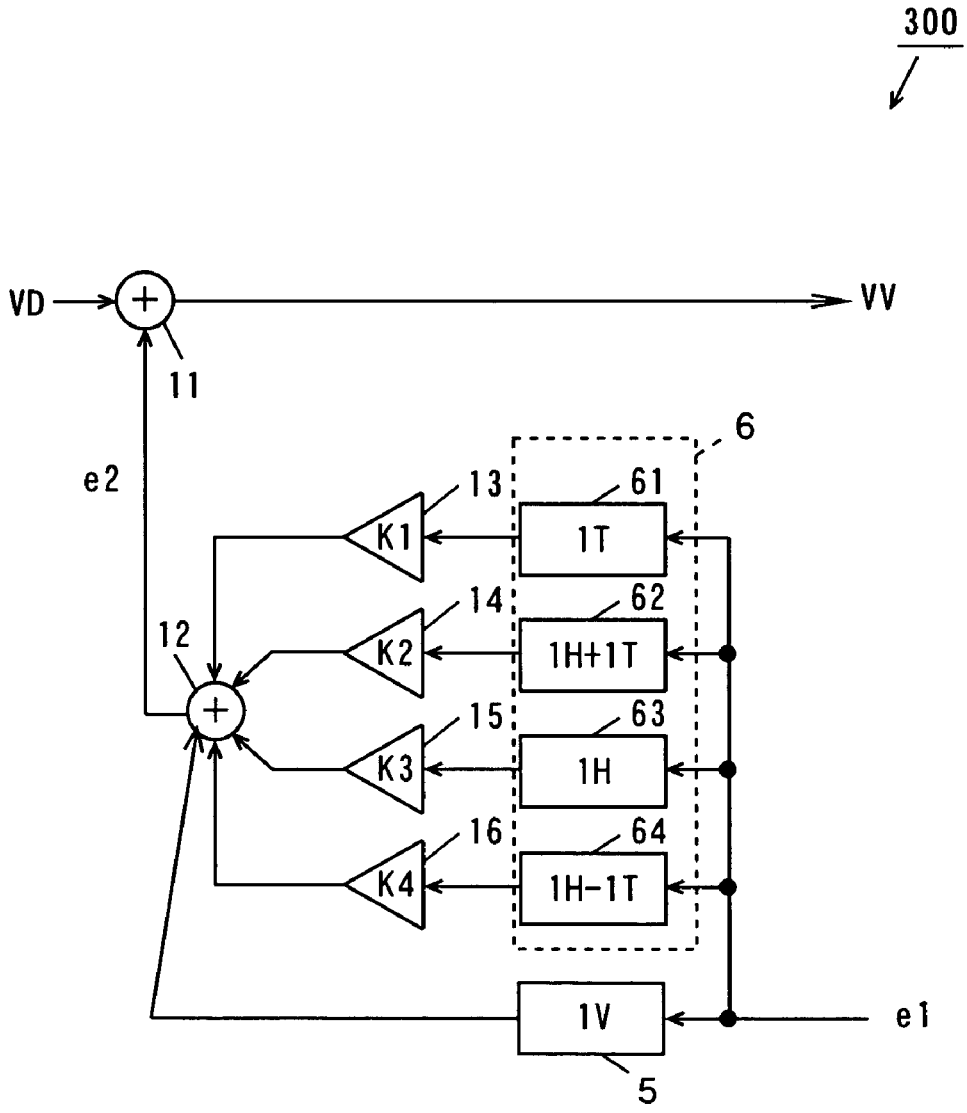
FIG. 6 is a block diagram showing the configuration of the error diffusion device shown in FIG. 1.

FIG. 6 is a block diagram showing the configuration of the error diffusion device 300 shown in FIG. 1.

As shown in FIG. 6, the error diffusion device 300 comprises adders 11, 12, multipliers 13 to 16, an inter-field delay device 5, and an intra-field delay device 6. The intra-field delay device 6 includes delay devices 61 to 64.

An error e1 outputted from the dither value generator 320 is inputted to the inter-field delay device 5. The inter-field delay device 5 delays the error e1 by a period of one field (1V), and outputs the delayed error e1 to the adder 12.

The error e1 is simultaneously inputted to the delay devices 61 to 64, respectively, in the intra-field delay device 6.

The delay device 61 delays the error e1 by a period of one pixel (1T) for output to the multiplier 13. The delay device 62 delays the error e1 by a period longer than one line by one pixel (1H+1T) for output to the multiplier 14. The delay device 63 delays the error e1 by a period of one line (1H) for output to the multiplier 15. The delay device 64 delays the error e1 by a period shorter than one line by one pixel (1H−1T) for output to the multiplier 16.

The multiplier 13 multiplies the error e1 that is outputted from the delay device 61 by a predetermined coefficient K1 for output to the adder 12. The multiplier 14 multiplies the error e1 that is outputted from the delay device 62 by a predetermined coefficient K2 for output to the adder 12. The multiplier 15 multiplies the error e1 that is outputted from the delay device 63*a* by a predetermined coefficient K3 for output to the adder 12. The multiplier 16 multiplies the error e1 that is outputted from the delay device 64 by a predetermined coefficient K4 for output to the adder 12.

Note that each of the coefficients K1, K2, K3, K4 is set to an appropriate value so as to satisfy the relation of K1+K2+K3+K4=1. For example, 7/16, 1/16, 5/16, and 3/16 are used as the coefficients K1, K2, K3, K4, respectively.

The adder 12 adds the output from the inter-field delay device 5 to the outputs from the multipliers 13 to 16, and outputs the result of addition to the adder 11 as a final error component e2.

The adder 11 then adds the final error component e2 that is outputted from the adder 12 to image data VD, thereby causing the final error component e2 to be diffused spatially and temporally.

In this embodiment, the error e1 outputted from the dither value generator 320 is diffused to the video signal temporally and spatially; however, without being limited to this example, the error e1 may be diffused to the image data VD temporally or spatially only.

Figure 7:
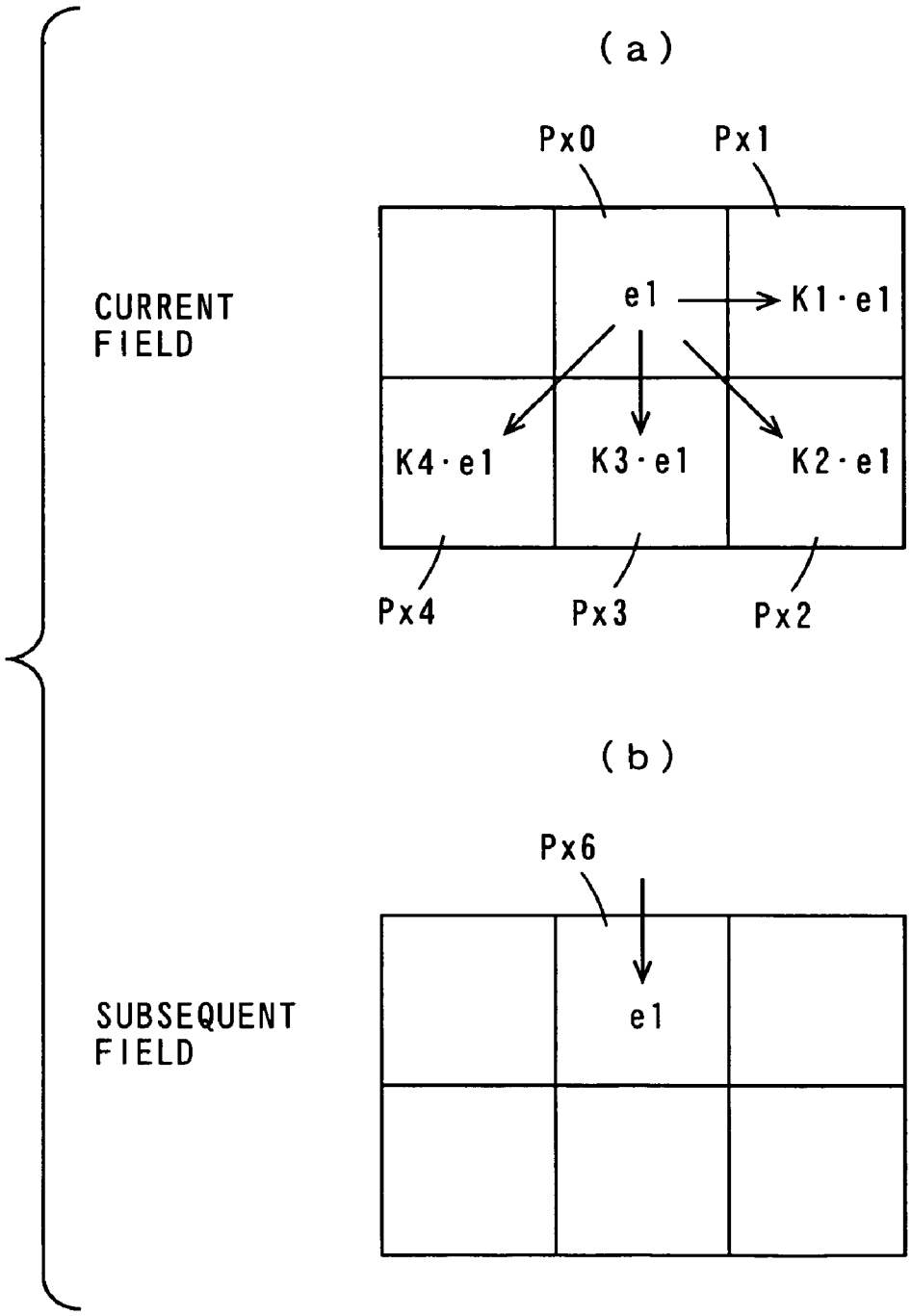
FIG. 7 (*a*) is a diagram showing spatial diffusion of an error, and FIG. 7 (*b*) is a diagram showing temporal diffusion of the error.

FIG. 7 (*a*) is a diagram showing spatial diffusion of the error e1, and FIG. 7 (*b*) is a diagram showing temporal diffusion of the error e1.

As shown in FIG. 7 (*a*), the error e1 of a pixel of interest Px0 is spatially diffused to the pixel Px1 that is adjacent on the right side of the same line, the pixel Px2 that is diagonally lower right on the lower line, the pixel Px3 that is adjacent below the pixel of interest Px0, and the pixel Px4 that is diagonally lower left.

The value obtained by the multiplication of the error e1 by the coefficient K1 is diffused to the pixel Px1, the value obtained by the multiplication of the error e1 by the coefficient K2 is diffused to the pixel Px2, the value obtained by the multiplication of the error e1 by the coefficient K3 is diffused to the pixel Px3, and the value obtained by the multiplication of the error e1 by the coefficient K4 is diffused to the pixel Px4.

The above-described error diffusion process enables the grayscale values corresponding to the grayscale level of the image data VD to be represented when the grayscale level of the image data VD and the average value of the grayscale values displayed by the respective first emission pattern to the fourth emission pattern are different from each other.

As shown in FIG. 7 (*b*), the error e1 of the pixel of interest Px0 is temporally diffused in the next field to the pixel Px6 with the same coordinates as those of the pixel of interest Px0.

The grayscale levels of the image data VD corresponding to the first pixel P1 to the fourth P4 are not necessarily equal. However, for example, when determining an error corresponding to the first pixel P1, the grayscale levels of the image data VD corresponding to the first pixel P1 to the fourth P4 are assumed to be equal, and the error is read from the dither table that is a difference between the grayscale level and the average value of grayscale values displayed by the first emission pattern to the forth emission pattern, respectively.

Next, another example of dither tables of the dither value generator 320 and another example of emission pattern tables of the sub-field converter 400 will be described.

FIG. 8 (*a*), 8 (*b*), 8 (*c*), 8 (*d*), 8 (*e*) are diagrams each for illustrating another example of a dither table of the dither value generator 320 and another example of an emission pattern table of the sub-field converter 400.

The relations between the grayscale levels and the first dither values to the fourth dither values in FIG. 8*a* to FIG. 8*d* as well as the relations between the grayscale levels and the errors in FIG. 8*e* are included in the dither tables of the dither value generator 320. In addition, the relations between the first grayscale values to the fourth grayscale values and the corresponding first emission patterns to the fourth emission patterns in FIG. 8*a* to FIG. 8*d* are included in the emission pattern table of the sub-field converter 400. The grayscale levels shown in FIG. 8*a*, FIG. 8*b*, FIG. 8*c*, and FIG. 8*d* denote the grayscale levels of a first pixel P1, a second pixel P2, a third pixel P3, and a fourth pixel P4, respectively.

In FIG. 8*a* to FIG. 8*d*, from the sub-field SF10 with the maximum weight to the sub-field SF1 with the minimum weight that are arranged in order of decreasing weight, combination patterns of emissions and non-emissions starting from a sub-field with the greatest weight of the sub-fields in which the pixels emit light to a predetermined number of sub-fields are different among all of the first pixel P1 to the fourth pixel P4 (condition 3).

The sub-fields in which the pixel emit light will be referred to as emission sub-fields, and the sub-fields in which the pixel does not emit light will be referred to as non-emission sub-fields.

In this embodiment, the predetermined number of sub-fields includes four sub-fields starting from a sub-field with the greatest weight of the emission sub-fields in each of the first emission patterns to fourth emission patterns.

In this case, a combination pattern of emissions and non-emissions of the four sub-fields in each of the first emission patterns to the fourth emission patterns is selected from the five patterns, i.e., "1110", "1101", "1011", "0111", and "1111".

For example, as denoted by the thick line in each of FIG. 8*a* to FIG. 8*d*, when the grayscale level of image data VV is "13", the sub-fields SF4-SF1 satisfy the condition 3. The combination patterns of emissions and non-emissions that satisfy the condition 3 are; "1011" for the first pixel P1 as shown in FIG. 8*a*, "1101" for the second pixel P2 as shown in FIG. 8*b*, "1110" for the third pixel P3 as shown in FIG. 8*c*, and "1111" for the fourth pixel as shown in FIG. 8*d*.

In this way, from the sub-field SF10 with the maximum weight to the sub-field SF1 with the minimum weight arranged in order of decreasing weight, combination patterns of emissions and non-emissions starting from a sub-field with the greatest weight of the sub-fields in which the pixels emit light to a predetermined number of sub-fields are different among all of the first pixel P1 to fourth pixel P4. A false contour noise that is generated by a combination pattern of emissions and non-emissions with great weights causes a significant degradation in image quality. The effect of reducing false contour noises therefore increases when the combination patterns of emissions and non-emissions which affect the represented grayscale values most are different.

Moreover, emission patterns are set using only the sub-fields with great weights which are likely to cause a false contour noise. This leads to a decrease in the design steps.

In addition to settings of emission patterns that satisfy the above-mentioned condition 1 and condition 2 or settings of emission patterns that satisfy the condition 2 and condition 3, in two or more emission patterns of the first emission patterns to the fourth emission patterns in FIG. 4*a* to FIG. 4*d* as well as in FIG. 8*a* to FIG. 8*d*, the combination patterns of emissions and non-emissions in predetermined sub-fields may be the same between adjacent grayscale levels (condition 4).

As such an example, settings of emission patterns that satisfy the condition 2, condition 3, and condition 4 will be described below with reference to FIG. 8*a*, 8*b*, 8*c*, 8*d*.

When, for example, a grayscale level "23" of the image data VV is represented using the first emission patterns to the fourth emission patterns in FIG. 8*a*, 8*b*, 8*c*, 8*d*, the corresponding sub-fields SF5-SF2 in the first, second, third, and fourth emission patterns are "0111", "1011", "1101", and "1110", respectively.

Moreover, when, for example, a grayscale level "24" that is adjacent to the above-mentioned grayscale level "23" is represented, the corresponding sub-fields SF5-SF2 in the first, second, third, and fourth emission patterns are "0111", "1011", "1110", and "1111", respectively.

In this case, among the sub-fields SF5 to the sub-fields SF2 in the first emission patterns to the fourth emission patterns for representing the grayscale level "23" and the grayscale level "24", the sub-fields SF5-SF2 for the grayscale levels "23" and "24" in the first emission patterns are the same, and the sub-fields SF5-SF2 for the grayscale levels "23" and "24" in the second emission patterns are the same.

In this case, the dither value changes by one or two between the adjacent grayscale levels. This means that a change in the dither value is smooth between the pixels with a small difference in their grayscale levels. As a result, false contour noises and noises due to dither patterns can be reduced.

In this way, image quality is further improved when the combination patterns of emissions and non-emissions in predetermined sub-fields are the same between adjacent grayscale levels in two or more emission patterns of the first emission patterns to the fourth emission patterns.

In this embodiment, the PDP 600 corresponds to a display panel; the coefficient adder 310, dither value generator 320, and sub-field converter 400 correspond to a grayscale display unit; the data driver 700, scan driver 800, and sustain driver 900 correspond to a driver; and the error diffusion device 300 corresponds to a diffusing device.

Note that in each of the first emission patterns to the fourth emission patterns, emission patterns may be set so as to reduce the places of non-emission sub-fields present among the emission sub-fields. This makes a false contour noise unlikely to be generated. For example, from the emission sub-field with the maximum weight to the sub-field with the minimum weight, the number of non-emission sub-fields that are present among emission-sub-fields may be limited to two or less.

In this embodiment, among the four pixels in each area, the first pixel P1 has the smallest grayscale value, the second pixel P2 has a grayscale value greater than that of the first pixel P1, the third pixel P3 has a grayscale value greater than that of the second pixel P2, and the fourth pixel P4 has the greatest grayscale value. In the next field, however, grayscale may be displayed so that the fourth pixel P4 has the smallest grayscale value, the third pixel P3 has a grayscale value greater than that of the fourth pixel, the first pixel P1 has a grayscale value greater than the third pixel P3, and the second pixel P2 has the greatest grayscale value.

That is, emission pattern tables may be set so that the grayscale values p1 to p4 of the first pixel P1 to the fourth pixel P4 and the average value pa thereof alternately repeat, for each field, the relations of the equation (1) and the equation (2) shown below:

$$P1<p2<pa<p3<p4 \quad (1)$$

$$P1>p2>pa>p3>p4 \quad (2)$$

When grayscale is displayed so that these magnitude relations between the grayscale values of the first pixel P1 to the fourth pixels P4 are alternately repeated for each field, noise is reduced that may be caused when the magnitude relations between the grayscale values of the first pixel P1 to the fourth pixel P4 are the same in each field.

Although in this embodiment, a plasma display apparatus is used as an example of a display apparatus for providing a grayscale display by the sub-field method, other display apparatuses including a digital mirror device and the like may also be used without being limited to a plasma display apparatus.

Second Embodiment

Figure 9:
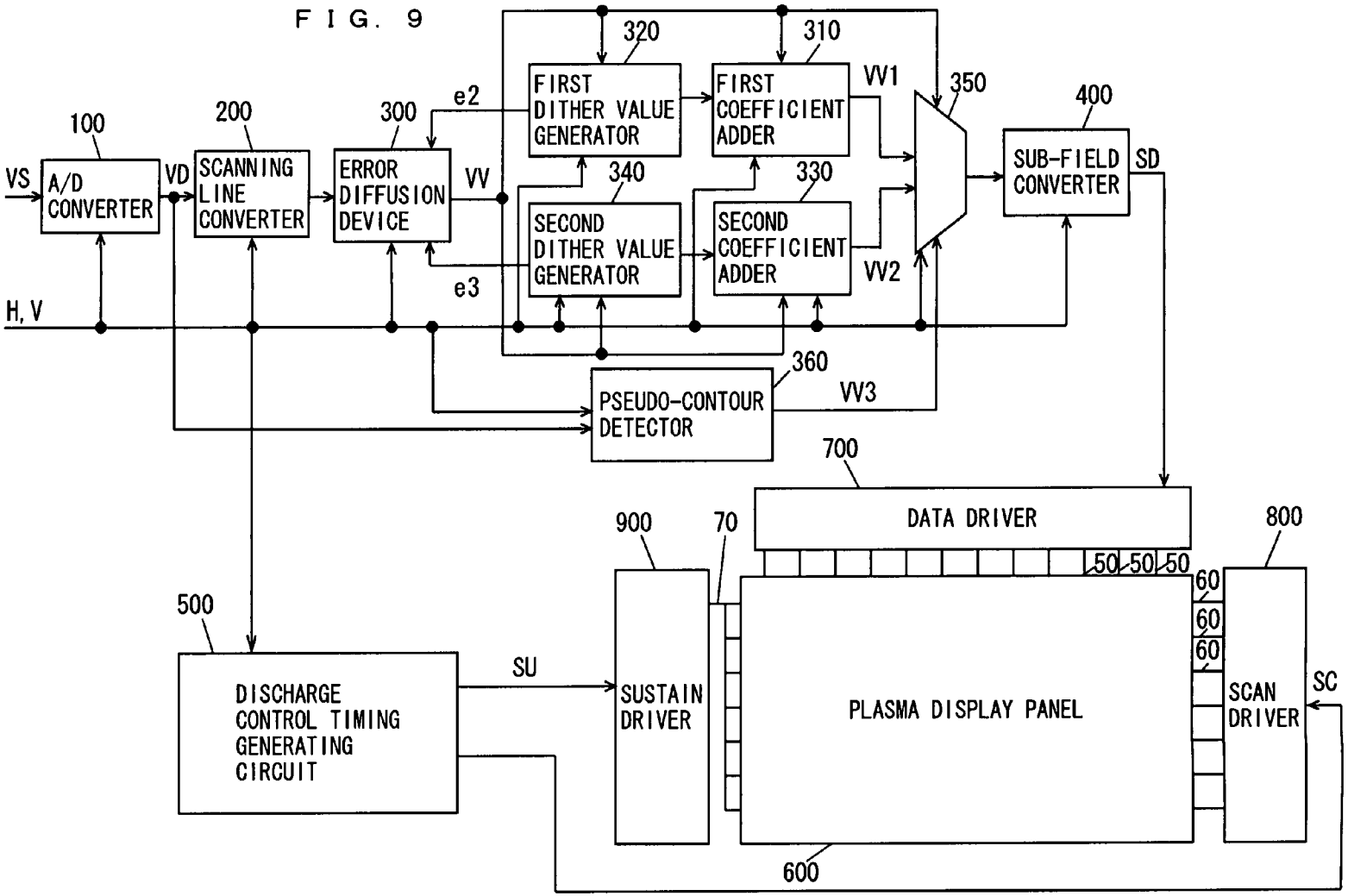
FIG. 9 is a block diagram showing the configuration of a plasma display apparatus according to a second embodiment of the invention.
Figure 11:
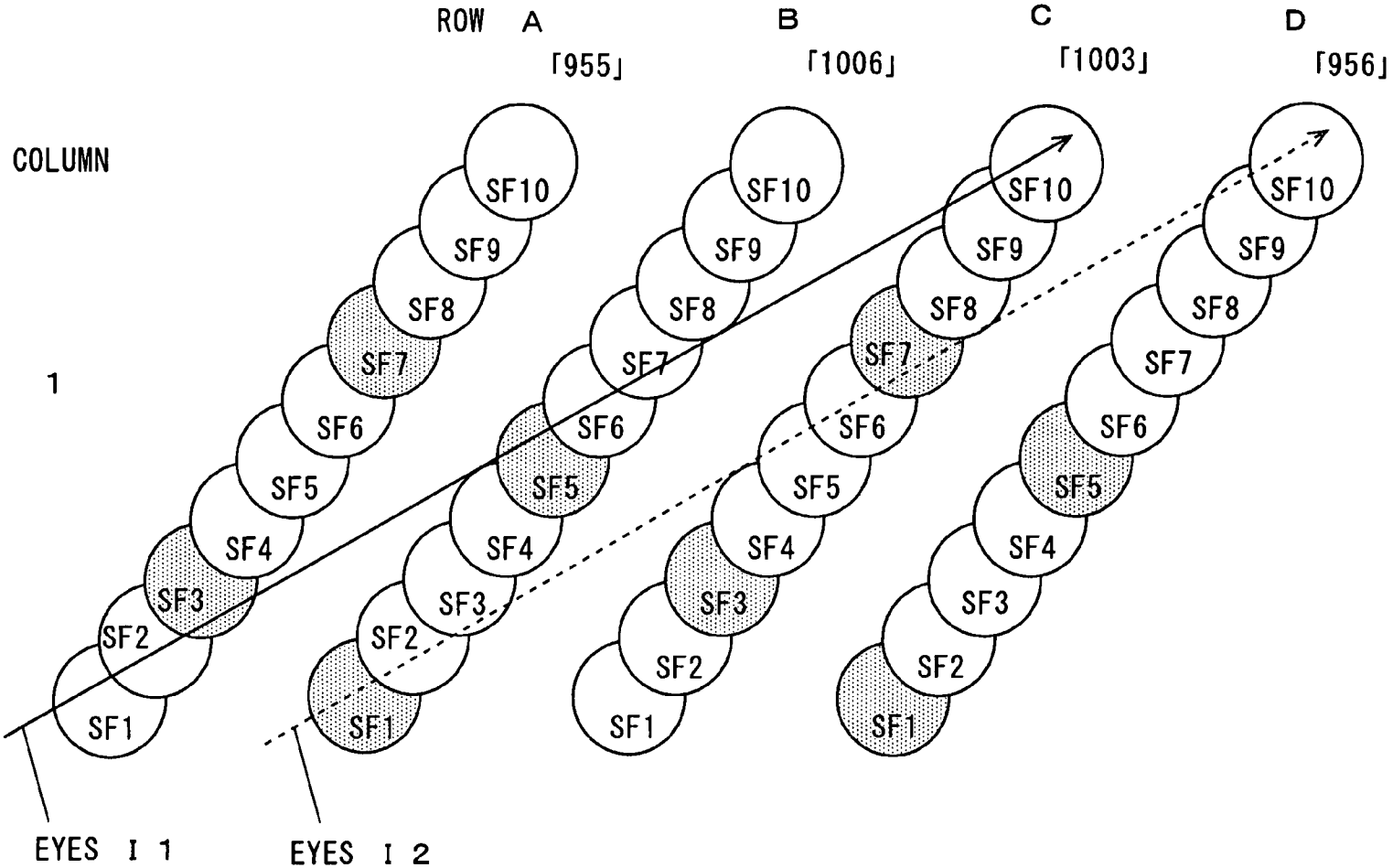
FIG. 11 PRIOR ART
FIG. 11 is a schematic diagram for illustrating a false contour noise that is visually perceived by a human eye moving on different pixels.

A second embodiment of the present invention will be described below. FIG. 9 is a block diagram showing the configuration of a plasma display apparatus according to the second embodiment of the present invention.

As shown in FIG. 9, the plasma display apparatus of this embodiment differs from that of the first embodiment in further having a second coefficient adder 330, a second dither value generator 340, a selector 350, and a false contour detector 360.

A horizontal synchronization signal H and a vertical synchronization signal V are supplied to the discharge control timing generating circuit 500, A/D converter 100, scanning line converter 200, error diffusion device 300, first coefficient adder 310, first dither value generator 320, second coefficient adder 330, second dither value generator 340, selector 350, false contour detector 360, and sub-field converter 400.

The error diffusion device 300 diffuses temporally and spatially an error e2 that is outputted from the first dither value generator 320 or an error e3 from the second dither value generator 340.

Image data VV that is derived from the error diffusion device 300 is supplied to the first coefficient adder 310, second coefficient adder 330, second dither value generator 340, and selector 350. The value of the image data VV represents the grayscale level of corresponding pixels.

The first dither value generator 320 stores dither tables that show relations between a plurality of grayscale levels represented by the image data VV and a plurality of dither values. The first dither value generator 320 also reads out dither values corresponding to the grayscale level of the image data VV from the dither tables, and supplies the dither values to the first coefficient adder 310. As used herein, a dither value corresponds to the difference between each grayscale level and the grayscale value that is displayed by each pixel.

The first coefficient adder 310 adds the dither values obtained from the first dither value generator 320 to the image data VV obtained from the error diffusion device 300, and supplies the result of addition to the selector 350 as image data VV1. The image data VV1 represents the grayscale values that are displayed by the respective four pixels in each area.

The second dither value generator 340 stores dither tables that show relations between a plurality of grayscale levels represented by the image data VV and a plurality of dither values. The second dither value generator 340 also reads out dither values corresponding to the grayscale level of the image data VV from the dither tables, and supplies the dither values to the second coefficient adder 330.

The second coefficient adder 330 adds the dither value obtained from the second dither value generator 340 to the image data VV obtained from the error diffusion device 300, and supplies the result of addition to the selector 350 as image data VV2. The image data VV2 represents the grayscale values that are displayed by the respective four pixels in each area.

The false contour detector 360 detects the degree of false contour noise generation based on such information as the emission patterns of sub-fields, the amount of the change in grayscale level, and the speed and the direction of motion of an image which are included in the image data VD, and supplies the result of detection to the selector 350. In this embodiment, the false contour detector 360 is composed of a motion detecting circuit that detects the amount of motion of an image.

Note that any other circuits capable of detecting a value associated with the degree of false contour noise generation may be used as the false contour detector 360 without being limited to the motion detecting circuit.

The selector 350 selects, based on the result of detection obtained from the false contour detector 360, any one of the image data VV supplied from the error diffusion device 300, image data VV1 supplied from the first coefficient adder 310, and image data VV2 supplied from the second coefficient adder 330, and supplies the selected data to the sub-field converter 400.

The sub-field converter 400 stores emission pattern tables that show relations between grayscale values represented by the respective four pixels in each area and corresponding emission patterns of a plurality of sub-fields. The sub-field converter 400 also converts, based on these emission pattern tables, any one of the image data VV, image data VV1, and image data VV2 to serial data SD corresponding to a plurality of sub-fields, and supplies the serial data SD to the data driver 700.

The dither tables of the first dither generator 320 as well as the emission pattern tables of the sub-field converter 400 corresponding to the dither tables are the same as the above-described dither tables and emission pattern tables shown in FIG. 8*a* to FIG. 8*e*.

The dither tables of the second dither value generator 340 and the emission pattern tables of the sub-field converter 400 corresponding to the dither tables will now be described.

FIG. 10*a*, 10*b*, 10*c*, 10*d*, 10*e* are diagrams each for illustrating the dither table of the second dither value generator 340 and the emission pattern table of the sub-field converter 400.

The relations between the grayscale levels and the first dither values to the fourth dither values in FIG. 10*a* to FIG. 10*d* as well as and the relations between the grayscale levels and the errors in FIG. 10*e* are included in the dither tables of the second dither value generator 340. The first dither value generator 320 and the second dither value generator 340 each determine to which of the first pixel P1 to fourth pixel P4 the image data VV corresponds, based on the horizontal synchronization signal H and vertical synchronization signal V, and selects a dither value corresponding to the pixel.

In addition, the relations between the first grayscale values to the fourth grayscale values and the corresponding first emission patterns to the fourth emission patterns in FIG. 10*a* to FIG. 10*d* are included in the emission pattern tables of the sub-field converter 400. FIG. 10*a* shows the grayscale levels of the first pixel P1, FIG. 10*b* shows the grayscale levels of the second pixel P2, FIG. 10*c* shows the grayscale levels of the third pixel P3, and FIG. 10*d* shows the grayscale levels of the fourth pixel P4.

Where the false contour detector 360 detects a great degree of false contour noise generation, the selector 350 selects the image data VV1 from the first coefficient adder 320. Where the false contour detector 360 detects a small degree of false contour noise generation, the selector 350 selects the image data VV2 from the second coefficient adder 340. Where the false contour detector 360 detects that no false contour noises would be generated, the selector 350 selects the image data VV from the error diffusion device 300.

In this embodiment, some of the combination patterns of emissions and non-emissions in predetermined sub-fields are the same among the first emission patterns to fourth emission patters in the dither tables of the second dither value generator 340.

For example, the sub-fields SF5-SF2 corresponding to the grayscale level "23" are "1010", "1011", "1011", and "1101" in the first, second, third, and fourth emission patterns, respectively. That is, the combination patterns of emissions and non-emissions in the sub-fields SF5-SF2 are the same between the second emission patterns and the third emission patterns.

This allows noise due to dither patterns to be reduced, even through the effect of false contour noise reduction is less than using the first emission patterns to the fourth emission patterns included in the dither tables of the first dither value generator 320.

As described above, in this embodiment, the image data VV, the image data VV1 that is outputted from the first coefficient adder 320, or the image data VV2 that is outputted from the second coefficient adder 340 is selectively used according to the degree of a false contour noise. This allows noises due to dither patterns to be minimized while reducing false contour noises.

In this embodiment, the first coefficient adder 310, second coefficient adder 330, first dither value generator 320, second dither value generator 340, selector 350, and sub-field converter 400 correspond to a grayscale display unit; the false contour detector 360 corresponds to a detector; the data driver 700, scan driver 800, and sustain driver 900 correspond to a driver; and the error diffusion device 300 corresponds to a diffusing device.

The invention claimed is:

1. A display apparatus for providing a grayscale display based on a video signal with a grayscale level using a sub-field method, comprising:

a display panel that is composed of a plurality of areas each including first, second, third, and fourth pixels that are vertically and horizontally adjacent to one another; and a grayscale display unit that stores first, second, third, and fourth tables that include a plurality of first, second, third, and fourth emission patterns corresponding to said respective first, second, third, and fourth pixels in each area, and selects first, second, third, and fourth emission patterns corresponding to said first, second, third, and fourth pixels, respectively, from said first, second, third, and fourth tables based on the grayscale level of the video signal, so as to provide a grayscale display by causing said first, second, third, and fourth pixels in each area of said display panel to emit light or not for each sub-field based on the selected first, second, third, and fourth emission patterns, wherein combination patterns of emissions and non-emissions in predetermined sub-fields of said plurality of sub-fields are different among said first, second, third, and fourth emission patterns, said first pixel and said second pixel are arranged in one diagonal positions while said third pixel and said fourth pixel are arranged in another diagonal positions in each area, and for each grayscale level, a grayscale value represented by each of said first emission pattern and said second emission pattern is lower than an average of grayscale values represented by said first, second, third, and fourth emission patterns, while a grayscale value represented by each of said third emission pattern and said fourth emission pattern is higher than said average.

2. The display apparatus according to claim 1, wherein said plurality of sub-fields have different weights from one another, and said predetermined sub-fields include, from a sub-field with the maximum weight to a sub-field with the minimum weight arranged in order of decreasing weight, a predetermined number of sub-fields starting from a sub-field with the greatest weight of the sub-fields in which a pixel emit light.

3. The display apparatus according to claim 1, wherein in two or more emission patterns of said first, second, third, and fourth emission patterns, said combination patterns of said predetermined sub-fields are the same between adjacent grayscale levels.

4. The display apparatus according to claim 1, further comprising a detector that detects a degree of a false contour noise in an image displayed on said display panel, wherein said grayscale display unit further stores fifth, sixth, seventh, and eighth tables that include a plurality of fifth, sixth, seventh, and eighth emission patterns corresponding to said first, second, third, and fourth pixels, respectively, and selects either of a set of said first table to said fourth table or a set of said fifth table to said eighth table based on a result of detection by said detector, and when selecting the set of said fifth table to said eighth table, said grayscale display unit selects fifth, sixth, seventh, and eighth emission patterns corresponding to said respective first, second, third, and fourth pixels in each area from the selected fifth, sixth, seventh, and eighth emission patterns based on the grayscale level of the video signal, so as to provide a grayscale display by causing said first, second, third, and fourth pixels in each area of said display panel to emit light or not for each sub-field based on the selected fifth, sixth, seventh, and eighth emission patterns, some of combination patterns of emissions and non-emissions in said predetermined sub-fields are the same among said fifth, sixth, seventh, and eighth emission patterns, and for each grayscale level, a grayscale value represented by each of said fifth emission pattern and said sixth emission pattern is lower than an average of grayscale values represented by said fifth, sixth, seventh, and eighth emission patterns, while a grayscale value represented by each of said seventh emission pattern and said eighth emission pattern is higher than said average.

5. The display apparatus according to claim 1, wherein said grayscale display unit includes:

a dither value generator that stores differences between each grayscale level and grayscale values represented by said respective first, second, third, and fourth emission patterns as first, second, third, and fourth dither values, and outputs first, second, third, and fourth dither values corresponding to the grayscale level of the video signal;

a coefficient adder that adds each of said first, second, third, and fourth dither values generated by said dither value generator to the grayscale level of the video signal; and a driver that stores said first, second, third, and fourth tables, and selects first, second, third, and fourth emission patterns from said first, second, third, and fourth tables based on the result of addition by said coefficient adder, so as to cause said first, second, third, and fourth pixels in each area of said display panel to emit light or not for each sub-field based on the selected first, second, third, and fourth emission patterns.

6. The display apparatus according to claim 1, further comprising a diffusion device that diffuses spatially and/or temporally an error in space and/or time between the grayscale level of the video signal and the average of the grayscale values represented by said respective first, second, third, and fourth emission patterns to the video signal when the grayscale level of the video signal and the average of the grayscale values represented by said respective first, second, third, and fourth emission patterns are different.

7. A display method for displaying grayscale on a display panel based on a video signal with a grayscale level using a sub-field method, said display panel being composed of a plurality of areas each including first, second, third, and fourth pixels that are vertically and horizontally adjacent to one another, said first pixel and said second pixel being arranged in one diagonal positions while said third pixel and said fourth pixel being arranged in another diagonal positions in each area, said method comprising the steps of:

storing first, second, third, and fourth tables that include a plurality of first, second, third, and fourth emission patterns corresponding to said first, second, third, and fourth pixels, respectively;

selecting first, second, third, and fourth emission patterns corresponding to said respective first, second, third, and fourth pixels in each area from said first, second, third, and fourth tables based on the grayscale level of the video signal; and displaying grayscale by causing said first, second, third, and fourth pixels in each area of said display panel to emit light or not for each sub-field based on the selected first, second, third, and fourth emission patterns, wherein combination patterns of emissions and non-emissions in predetermined sub-fields of said plurality of sub-fields are different among said first, second, third, and fourth emission patterns, and for each grayscale level, a grayscale value represented by each of said first emission pattern and said second emission pattern is lower than an average of grayscale values represented by said first, second, third, and fourth emission patterns, while a grayscale value represented by each of said third emission pattern and said fourth emission pattern is higher than said average.

8. The display method according to claim 7, wherein said plurality of sub-fields have different weights from one another, and said predetermined sub-fields include, from a sub-field with the maximum weight to a sub-field with the minimum weight arranged in order of decreasing weight, a predetermined number of sub-fields starting from a sub-field with the greatest weight of the sub-fields in which a pixel emit light.

9. The display method according to claim 7, wherein in two or more emission patterns of said first, second, third, and fourth emission patterns, said combination patterns in said predetermined sub-fields are the same between adjacent grayscale levels.

10. The display method according to claim 7, further comprising the steps of:

detecting a degree of a false contour noise in an image displayed by said display panel;

storing fifth, sixth, seventh, and eighth tables that include a plurality of fifth, sixth, seventh, and eighth emission patterns corresponding to said first, second, third, and fourth pixels, respectively;

selecting either of a set of said first table to said fourth table or a set of said fifth table to said eighth table based on the result of detection of the degree of a false contour noise;

when the set of said fifth table to said eighth table is selected, selecting fifth, sixth, seventh, and eighth emission patterns corresponding to said respective first, second, third, and fourth pixels in each area from said selected fifth, sixth, seventh, and eighth tables based on the grayscale level of the video signal; and displaying grayscale by causing said first, second, third, and fourth pixels in each area of said display panel to emit light or not for each sub-field based on said selected fifth, sixth, seventh, and eighth tables, wherein some of combination patterns of emissions and non-emissions in said predetermined sub-fields are the same among said fifth, sixth, seventh, and eighth emission patterns, and for each grayscale level, a grayscale value represented by each of said fifth emission pattern and said sixth emission pattern is lower than an average of grayscale values represented by said fifth, sixth, seventh, and eighth emission patterns, while a grayscale value represented by each of said seventh emission pattern and said eighth emission pattern is higher than said average.

11. The display method according to claim 7, wherein said step of displaying grayscale includes the steps of:

storing differences between each grayscale level and grayscale values represented by said respective first, second, third, and fourth emission patterns as first, second, third, and fourth dither values;

outputting first, second, third, and fourth dither values corresponding to the grayscale level of the video signal;

adding each of said generated first, second, third, and fourth dither values to the grayscale level of the video signal;

storing said first, second, third, and fourth tables;

selecting first, second, third, and fourth emission patterns from said first, second, third, and fourth tables based on the result of addition; and causing said first, second, third, and fourth pixels in each area of said display to emit light or not for each sub-field based on the selected first, second, third, and fourth emission patterns.

12. The display method according to claim 7, further comprising the step of diffusing spatially and/or temporally an error between the grayscale level of the video signal and the average of the grayscale values represented by said respective first, second, third, and fourth emission patterns to the video signal when the grayscale level of the video signal and the average of the grayscale values represented by said respective first, second, third, and fourth emission patterns are different.

* * * * *